US012345451B2

(12) United States Patent
Yu et al.

(10) Patent No.: US 12,345,451 B2
(45) Date of Patent: Jul. 1, 2025

(54) REFRIGERATION SYSTEM

(71) Applicants: York Guangzhou Air Conditioning and Refrigeration Co., Ltd., Qingyuan (CN); Johnson Controls Technology Company, Auburn Hills, MI (US)

(72) Inventors: Demao Yu, Qingyuan (CN); Shuang Wu, Qingyuan (CN)

(73) Assignees: York Guangzhou Air Conditioning and Refrigeration Co., Ltd., Qingyuan (CN); Tyco Fire & Security GmbH, Neuhausen am Rheinfall (CH)

( * ) Notice: Subject to any disclaimer, the term of this patent is extended or adjusted under 35 U.S.C. 154(b) by 931 days.

(21) Appl. No.: 17/311,276

(22) PCT Filed: Aug. 1, 2019

(86) PCT No.: PCT/CN2019/098852
§ 371 (c)(1),
(2) Date: Dec. 14, 2021

(87) PCT Pub. No.: WO2020/113980
PCT Pub. Date: Jun. 11, 2020

(65) Prior Publication Data

US 2022/0099345 A1 Mar. 31, 2022

(30) Foreign Application Priority Data

Dec. 5, 2018 (CN) ..... 201811482252.7

(51) Int. Cl.
*F25B 41/20* (2021.01)
*F25B 13/00* (2006.01)
(Continued)

(52) U.S. Cl.
CPC ..... *F25B 41/20* (2021.01); *F25B 13/00* (2013.01); *F25B 41/24* (2021.01); *F25B 41/40* (2021.01); *F25B 45/00* (2013.01); *F25B 49/02* (2013.01)

(58) Field of Classification Search
CPC ..... F25D 41/20; F25D 41/22; F25D 41/24; F25D 41/26; F25D 41/40; F25D 41/42;
(Continued)

(56) References Cited

U.S. PATENT DOCUMENTS 6,032,473 A 3/2000 Morimoto et al.
2006/0288724 A1* 12/2006 Ambs ..... F25B 30/06 62/260
(Continued)

FOREIGN PATENT DOCUMENTS

CN 87101888 A 8/1988
CN 1102753 A 5/1995
(Continued)

OTHER PUBLICATIONS

European Search Report for EP Application No. 19892060.5, dated Nov. 28, 2022, 10 pages.
(Continued)

*Primary Examiner* — Jianying C Atkisson
*Assistant Examiner* — For K Ling
(74) *Attorney, Agent, or Firm* — Fletcher Yoder, P.C.

(57) ABSTRACT

Disclosed is a refrigeration system, comprising refrigeration system components, a connecting pipeline, a switch structure, and discharging channels (123, 124; 623, 624). The refrigeration system components comprise three heat exchangers (101; 102; 112). The refrigeration system components can be connected via the connecting pipeline, and are combined into different working systems via the switch structure. When two heat exchangers are selected by the
(Continued)

switch structure to form one working system and the saturation temperature corresponding to the internal pressure of the unselected heat exchanger is higher than the medium or environment temperature of the heat exchanger, a liquid refrigerant accumulates inside the non-working heat exchanger. According to the refrigeration system, the switch structure is arranged at either end of the non-working heat exchanger, so that the non-working heat exchanger is isolated from a working system cycle, and under the condition where the pressure at a low-pressure side (C; Q) of the working system is less than the internal pressure of the non-working heat exchanger, additional discharging channels (123, 124; 623, 624) communicate with the non-working heat exchanger and the low-pressure side (C; Q) of the working system, so that the refrigerant accumulating in the non-working heat exchanger is transferred to the system cycle, avoiding a lack of refrigerant in the system cycle.

14 Claims, 12 Drawing Sheets

(51) Int. Cl.

| | |
|---|---|
| ***F25B 41/24*** | (2021.01) |
| ***F25B 41/40*** | (2021.01) |
| ***F25B 45/00*** | (2006.01) |
| ***F25B 49/02*** | (2006.01) |

(58) Field of Classification Search
CPC ..... F25D 41/45; F25B 2313/003; F25B 2313/004; F25B 2313/009; F25B 2313/02741; F25B 2600/2507; F25B 2600/2501; F25B 2600/2513; F25B 13/00
See application file for complete search history.

(56) References Cited

U.S. PATENT DOCUMENTS

| | | | | |
|---|---|---|---|---|
| 2013/0269380 | A1* | 10/2013 | Oya | F25B 13/00 62/190 |
| 2013/0306301 | A1* | 11/2013 | Tamaki | F25B 41/20 165/287 |
| 2016/0116191 | A1* | 4/2016 | Tamaki | F25B 47/025 62/160 |
| 2019/0346189 | A1* | 11/2019 | Saito | F25B 30/02 |

FOREIGN PATENT DOCUMENTS

| | | | | |
|---|---|---|---|---|
| CN | 1692259 | A | 11/2005 | |
| CN | 1821664 | A | 8/2006 | |
| CN | 101384866 | A | 3/2009 | |
| CN | 102080904 | A | 6/2011 | |
| CN | 102734881 | A | 10/2012 | |
| CN | 104457026 | A | 3/2015 | |
| CN | 109028413 | A | 12/2018 | |
| EP | 3285021 | A1 | 2/2018 | |
| JP | H10281597 | A | 10/1998 | |
| JP | WO2012104890 | A1 | 7/2014 | |
| JP | 2018124046 | A * | 8/2018 | F25B 13/00 |
| TW | 201716730 | A | 5/2017 | |

OTHER PUBLICATIONS

PCT International Search Report for PCT Application No. PCT/CN2019/098852 mailed Oct. 30, 2019, 4 pgs.

* cited by examiner

REFRIGERATION SYSTEM

CROSS-REFERENCE TO RELATED APPLICATIONS

This application is a U.S. National Stage Application of PCT Application No. PCT/CN2019/098852, entitled "REFRIGERATION SYSTEM," filed Aug. 1, 2019, which claims priority to and the benefit of Chinese Patent Application No. 201811482252.7, filed Dec. 5, 2018, each of which is herein incorporated by reference in its entirety for all purposes.

TECHNICAL FIELD

The present application relates to the technical field of refrigeration systems.

BACKGROUND ART

Refrigeration systems are commonly used for many types of units, such as full heat recovery units, air conditioning/hot water multifunctional units and four-tube refrigeration/hot water units. Existing full heat recovery units, air conditioning/hot water multifunctional units and four-tube refrigeration/hot water units generally have three or more heat exchangers. During unit operation, some of the heat exchangers in the refrigeration system are not operational, and liquid refrigerant will accumulate inside the non-operational heat exchangers, resulting in a shortage of refrigerant during unit operation, and affecting the normal running of the unit.

SUMMARY OF THE INVENTION

The present application provides a refrigeration system, comprising: refrigeration system components, connecting pipelines and a switch structure. The refrigeration system components comprise a compressor, a first heat exchanger, a second heat exchanger, a third heat exchanger, a first throttle valve and a second throttle valve; the connecting pipelines are capable of connecting all of the abovementioned refrigeration system components, and capable of combining the refrigeration system components in different ways to form multiple different operating systems; the switch structure is configured to be capable of connecting the connecting pipelines to form one operating system, and capable of selecting, from the first heat exchanger, the second heat exchanger and the third heat exchanger, two heat exchangers for connection into said one operating system, and isolating a non-selected heat exchanger from said one operating system.

The refrigeration system as described above further comprises a discharge path, the discharge path being selectively arranged between the non-selected heat exchanger and a low-pressure side of said one operating system, and capable of controllably connecting the non-selected heat exchanger to the low-pressure side of said one operating system.

In the refrigeration system as described above, the discharge path is arranged between the non-selected heat exchanger and the low-pressure side of said one operating system when the temperature of a medium, which undergoes heat transfer with a refrigerant, in the non-selected heat exchanger or the temperature of an environment in which the non-selected heat exchanger is located is lower than a saturation temperature of refrigerant in the non-selected heat exchanger.

In the refrigeration system as described above, when the discharge path is arranged between the non-selected heat exchanger and the low-pressure side of said one operating system, the refrigeration system is configured such that: (i) when a pressure of the low-pressure side of said one operating system is lower than a pressure in the non-selected heat exchanger, the discharge path is connected so that refrigerant in the non-selected heat exchanger flows into the low-pressure side of said one operating system; (ii) when the pressure of the low-pressure side of said one operating system is not lower than the pressure in the non-selected heat exchanger, the first throttle valve or second throttle valve is first adjusted to lower the pressure of the low-pressure side of said one operating system, so that refrigerant in the non-selected heat exchanger is able to flow into the low-pressure side of said one operating system, the discharge path is then connected so that refrigerant in the non-selected heat exchanger flows into the low-pressure side of said one operating system, and the discharge path is disconnected when discharge has taken place for a period of time.

In the refrigeration system as described above, the discharge path comprises a discharge switch device for controlling the connection and disconnection of the discharge path.

In the refrigeration system as described above, the discharge switch device comprises a first disconnection device and a second disconnection device; the first disconnection device is configured to connect the second heat exchanger to or disconnect the second heat exchanger from a low-pressure side of an operating system formed by the compressor, the first heat exchanger, the third heat exchanger and either one or both of the first throttle valve and the second throttle valve; the second disconnection device is configured to connect the third heat exchanger to or disconnect the third heat exchanger from a low-pressure side of an operating system formed by the compressor, the first heat exchanger, the second heat exchanger and either one or both of the first throttle valve and the second throttle valve.

In the refrigeration system as described above, the refrigeration system further comprises a pressure detection device and a temperature detection device; the pressure detection device is configured to be capable of detecting the pressure of the low-pressure side of the operating system, and providing a pressure detection signal; the temperature detection device is configured to be capable of detecting a temperature in the non-selected heat exchanger, and providing a temperature detection signal.

In the refrigeration system as described above, the refrigeration system further comprises a control device, the control device being in communicative connection with the discharge switch device, and being configured to control the connection and disconnection of the discharge path according to the pressure detection signal detected by the pressure detection device and the temperature detection signal detected by the temperature detection device.

In the refrigeration system as described above, the operating system comprises a first operating system and a second operating system; the first operating system is formed by connection of a first series-connected path, the first series-connected path series-connecting in sequence the compressor, the first heat exchanger, the second heat exchanger, the first throttle valve and the third heat exchanger, wherein the first heat exchanger and the second heat exchanger act as condensers, and the third heat exchanger acts as an evaporator; the second operating system is formed by connection of a second series-connected path, the second series-connected path series-connecting in sequence the compressor, the first heat exchanger, the third heat exchanger, the first throttle valve and the second heat exchanger, wherein the first heat exchanger and the third heat exchanger act as condensers, and the second heat exchanger acts as an evaporator; the switch structure comprises a path switching device, and the first operating system and the second operating system can be selectively switched by means of the path switching device.

In the refrigeration system as described above, the switch structure further comprises a third disconnection device, a fourth disconnection device and a fifth disconnection device; the third disconnection device is connected between the first heat exchanger and the path switching device; the fourth disconnection device is connected between the second heat exchanger and the first throttle valve; the fifth disconnection device is connected between the third heat exchanger and the first throttle valve; the second throttle valve has one end connected between the first heat exchanger and the third disconnection device, and another end connected between the fourth disconnection device and the first throttle valve; the operating system further comprises a third operating system and a fourth operating system; the third operating system is formed by a third series-connected path, and when the third operating system is formed, the third series-connected path is configured such that: the third disconnection device and the fourth disconnection device are disconnected, the second heat exchanger in the first series-connected path is separated from the first series-connected path, and the sequential series connection of the compressor, the first heat exchanger, the second throttle valve, the first throttle valve and the third heat exchanger is maintained, wherein the first heat exchanger acts as a condenser, and the third heat exchanger acts as an evaporator; the fourth operating system is formed by a fourth series-connected path, and when the fourth operating system is formed, the fourth series-connected path is configured such that: the third disconnection device and the fifth disconnection device are disconnected, the third heat exchanger in the second series-connected path is separated from the second series-connected path, and the sequential series connection of the compressor, the first heat exchanger, the second throttle valve and the second heat exchanger is maintained, wherein the first heat exchanger acts as a condenser, and the second heat exchanger acts as an evaporator.

In the refrigeration system as described above, the path switching device is a four-way valve, provided with a first pair of controllable paths and a second pair of controllable paths; the first pair of controllable paths comprises a first controllable path and a second controllable path, the first controllable path being connected between the third disconnection device and the second heat exchanger, and the second controllable path being connected between the third heat exchanger and the compressor; the second pair of controllable paths comprises a third controllable path and a fourth controllable path, the third controllable path being connected between the third disconnection device and the third heat exchanger, and the fourth controllable path being connected between the second heat exchanger and the compressor; wherein the first pair of controllable paths can connect the first series-connected path and the third series-connected path; and the second pair of controllable paths can connect the second series-connected path and the fourth series-connected path.

In the refrigeration system as described above, the operating system comprises a first combined operating system and a second combined operating system; the switch structure comprises a first switching assembly, the first switching assembly being configured to switch the first combined operating system and second combined operating system; the first combined operating system comprises a fifth operating system and a sixth operating system; the fifth operating system is formed by a fifth series-connected path, the fifth series-connected path comprising the compressor, the third heat exchanger, the second throttle valve and the second heat exchanger connected in sequence, wherein the third heat exchanger acts as a condenser, and the second heat exchanger acts as an evaporator; the sixth operating system is formed by a sixth series-connected path, the sixth series-connected path comprising the compressor, the second heat exchanger, the second throttle valve and the third heat exchanger connected in sequence, wherein the second heat exchanger acts as a condenser, and the third heat exchanger acts as an evaporator; the switch structure comprises a second switching assembly, and the fifth operating system and the sixth operating system can be switched by means of the second switching assembly.

In the refrigeration system as described above, the second combined operating system comprises a seventh operating system and an eighth operating system; the seventh operating system is formed by a seventh series-connected path, the seventh series-connected path comprising the compressor, the first heat exchanger, the first throttle valve and the second heat exchanger connected in sequence, wherein the first heat exchanger acts as a condenser, and the second heat exchanger acts as an evaporator; and the eighth operating system is formed by an eighth series-connected path, the eighth series-connected path comprising the compressor, the first heat exchanger, the first throttle valve and the third heat exchanger connected in sequence, wherein the first heat exchanger acts as a condenser, and the third heat exchanger acts as an evaporator; the switch structure further comprises a third switching assembly, and the seventh operating system and the eighth operating system can be switched by means of the combination of the second switching assembly and the third switching assembly.

In the refrigeration system as described above, the first switching assembly is a three-way valve, provided with a first three-way controllable path and a second three-way controllable path, the first three-way controllable path being connected between the first heat exchanger and the compressor, and the second three-way controllable path being connected between the second switching assembly and the compressor; wherein the first three-way controllable path can connect the seventh series-connected path and the eighth series-connected path; the second three-way controllable path can connect the fifth series-connected path and the sixth series-connected path; the second switching assembly is a four-way valve, provided with a first set of control paths and a second set of control paths; the first set of control paths comprises a first control path and a second control path, the first control path being connected between the first switching assembly and the second heat exchanger, and the second control path being connected between the third heat exchanger and the compressor; the second set of control paths comprises a third control path and a fourth control path, the third control path being connected between the first switching assembly and the third heat exchanger, and the fourth control path being connected between the second heat exchanger and the compressor; wherein the first set of control paths can connect the sixth series-connected path and the eighth series-connected path; the second set of control paths can connect the fifth series-connected path and the seventh series-connected path; the third switching assembly comprises a sixth disconnection device and a seventh disconnection device; the sixth disconnection device is connected between the second heat exchanger and the first throttle valve, and the seventh disconnection device is connected between the third heat exchanger and the first throttle valve; wherein the sixth disconnection device can connect the seventh series-connected path; and the seventh disconnection device can connect the eighth series-connected path.

In the refrigeration system as described above, the first heat exchanger and the second heat exchanger are both water-side heat exchangers, and the third heat exchanger is a wind-side heat exchanger.

In the refrigeration system as described above, a gas/liquid separator is provided at a gas suction side of the compressor.

In the refrigeration system of the present application, the switch structure is added at two ends of the heat exchanger which might not be operational, and a liquid extraction return path is added between the non-operational heat exchanger and the low-pressure side of the operating system, so that when refrigerant accumulates inside the heat exchanger because it is not operational, the refrigeration system of the present application can disconnect the two ends of the non-operational heat exchanger from the currently running refrigeration cycle by means of the switch structure, and extract the accumulated refrigerant into the currently running refrigeration cycle by means of the liquid extraction return path. This arrangement avoids shortage of refrigerant in the system circulation when a unit in the refrigeration system is running, thereby facilitating the normal running of the refrigeration system.

An object of the present application is to provide a refrigeration system, such that when the refrigeration system is operating and a saturation temperature of refrigerant corresponding to pressure inside a non-operational heat exchanger in the refrigeration system is higher than the temperature of an environment or a medium in the heat exchanger, refrigerant that has accumulated in the non-operational heat exchanger can be extracted into the operating system, so that the operating system can run normally.

DETAILED DESCRIPTION OF THE INVENTION

Figure 1A:
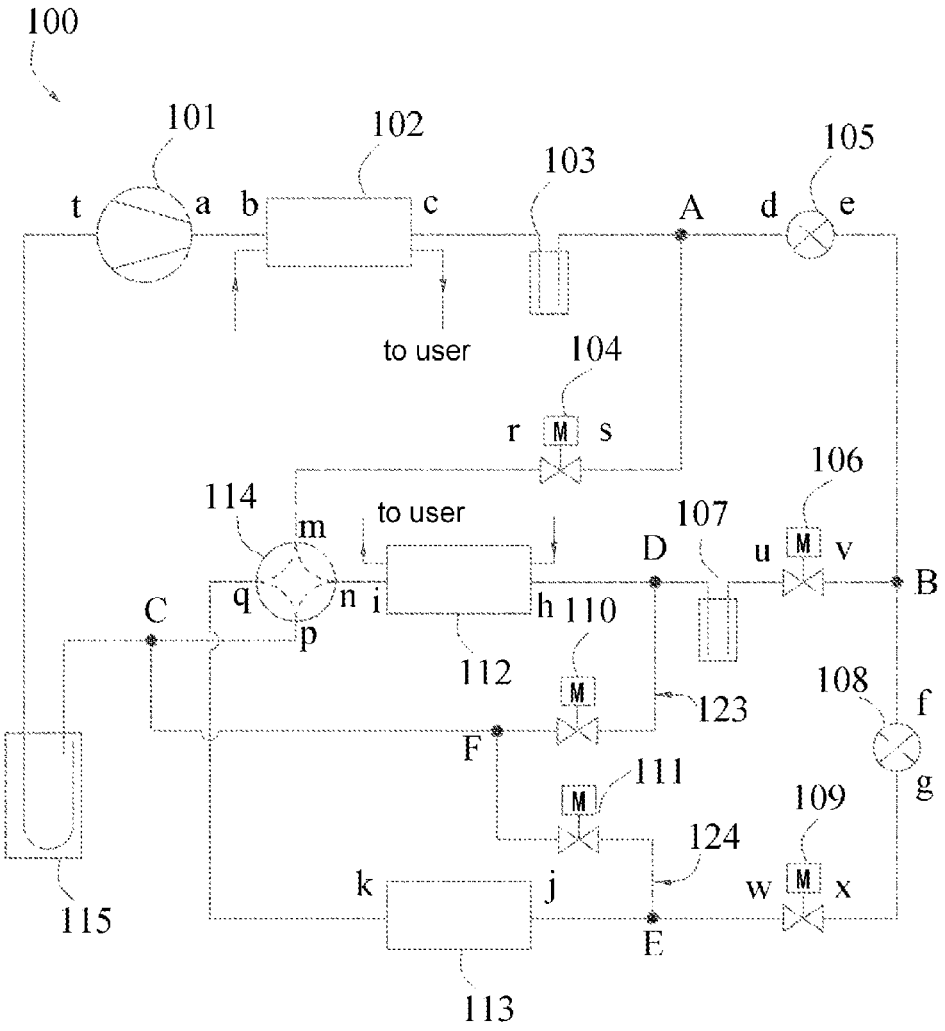
FIG. 1A shows a refrigeration system in a first embodiment of the present application.

Various particular embodiments of the present application are described below with reference to the drawings, which form part of this specification. It should be understood that although terms indicating direction, such as "upper" and "lower", etc., are used in the present application to describe various exemplary structural parts and elements of the present application, these terms are used here merely in order to facilitate explanation, and determined on the basis of the exemplary orientations shown in the drawings. Since the embodiments disclosed in the present application can be configured in different directions, these terms indication direction are merely explanatory and should not be regarded as limiting.

FIG. 1A shows a refrigeration system 100 in a first embodiment of the present application. As shown in FIG. 1A, the refrigeration system 100 comprises a compressor 101, a first heat exchanger 102, a second heat exchanger 112, a third heat exchanger 113, a first throttle valve 108, a second throttle valve 105, a first liquid reservoir 103, a second liquid reservoir 107 and a gas/liquid separator 115. The compressor 101 is configured to compress refrigerant to a high-temperature, high-pressure fluid. The first heat exchanger 102 and second heat exchanger 112 are both water-side heat exchangers. When refrigerant flows through the first heat exchanger 102 and second heat exchanger 112, it can exchange heat with a water medium in the first heat exchanger 102 and second heat exchanger 112 that is supplied to a user, so that the temperature of the refrigerant rises or falls. The third heat exchanger 113 in the present application is a wind-side heat exchanger. When refrigerant flows through the third heat exchanger 113, it can exchange heat with external air via the third heat exchanger 113, so that the temperature of the refrigerant rises or falls. The first liquid reservoir 103 and second liquid reservoir 107 are configured to store refrigerant in the refrigeration system 100. The gas/liquid separator 115 is configured to separate gaseous refrigerant and liquid refrigerant entering the gas/liquid separator 115, so that the refrigerant which flows out of the gas/liquid separator 115 is gaseous refrigerant.

The refrigeration system 100 further comprises a switch structure, configured to enable the refrigeration system 100 to switch among different operating systems. The switch structure comprises a path switching device 114, a third disconnection device 104, a fourth disconnection device 106 and a fifth disconnection device 109. Specifically, the third disconnection device 104, fourth disconnection device 106 and fifth disconnection device 109 are solenoid valves. The path switching device 114 is a four-way valve, having a total of four ports, specifically a first port m, a second port n, a third port p and a fourth port q. The four-way valve is provided with a first pair of controllable paths and a second pair of controllable paths. The first pair of controllable paths comprises a first controllable path mn and a second controllable path pq. The first controllable path mn can connect the first port m and the second port n. The second controllable path pq can connect the third port p and the fourth port q. The second pair of controllable paths comprises a third controllable path mq and a fourth controllable path np. The third controllable path mq can connect the first port m and the fourth port q; the fourth controllable path np can connect the second port n and the third port p.

As shown in FIG. 1A, the various components mentioned above are connected by connecting pipelines to form the refrigeration system 100. Specifically, the third port p of the path switching device 114 is connected to a gas suction end t of the compressor 101; the gas/liquid separator 115 is disposed between connecting pipelines of the third port p and the gas suction end t of the compressor 101. A gas discharge end a of the compressor 101 is connected to an end b of the first heat exchanger 102; another end c of the first heat exchanger 102 is connected to an end s of the third disconnection device 104; another end r of the third disconnection device 104 is connected to the first port m. The first liquid reservoir 103 is disposed on the connecting pipeline between the end c of the first heat exchanger 102 and the end s of the third disconnection device 104.

The second port n of the path switching device 114 is connected to an end i of the second heat exchanger 112; another end h of the second heat exchanger 112 is connected to an end u of the fourth disconnection device 106. Another end v of the fourth disconnection device 106 is connected to an end e of the second throttle valve 105. Another end d of the second throttle valve 105 is connected at a connection point A between the first liquid reservoir 103 and the third disconnection device 104. The second liquid reservoir 107 is disposed on the connecting pipeline between the other end h of the second heat exchanger 112 and the end u of the fourth disconnection device 106.

The fourth port q of the path switching device 114 is connected to an end k of the third heat exchanger 113; another end j of the third heat exchanger 113 is connected to an end w of the fifth disconnection device 109; another end x of the fifth disconnection device 109 is connected to an end g of the first throttle valve 108; another end f of the first throttle valve 108 is connected at a connection point B between the fourth disconnection device 106 and the second throttle valve 105.

The refrigeration system 100 further comprises a discharge path. Specifically, the discharge path comprises a first discharge path 123 and a second discharge path 124. The first discharge path 123 and second discharge path 124 can be controllably connected or disconnected by a discharge switch device. As an example, the discharge switch device comprises a first disconnection device 110 and a second disconnection device 111. The first disconnection device 110 and second disconnection device 111 are solenoid valves.

One end of the first discharge path 123 is connected at a connection point C between the gas/liquid separator 115 and the third port p; another end of the first discharge path 123 is connected at a connection point D between the second liquid reservoir 107 and the second heat exchanger 112. The first disconnection device 110 is disposed on the first discharge path 123. One end of the second discharge path 124 is connected at a connection point E between the third heat exchanger 113 and the fifth disconnection device 109; another end of the second discharge path 124 is connected at a connection point F between the connection point C and the first disconnection device 110. The second disconnection device 111 is disposed on the second discharge path 124.

The refrigeration system 100 shown in FIG. 1A can realize four operating systems, comprising a first operating system, a second operating system, a third operating system and a fourth operating system, through the cooperation of the switch structure, the first throttle valve 108 and the second throttle valve 105. When the refrigeration system 100 is set to the first operating system and third operating system, the first pair of controllable paths in the path switching device 114 are connected and the second pair of controllable paths are disconnected. When the refrigeration system 100 is set to the second operating system and fourth operating system, the second pair of controllable paths in the path switching device 114 are connected and the first pair of controllable paths are disconnected.

Figure 1B:
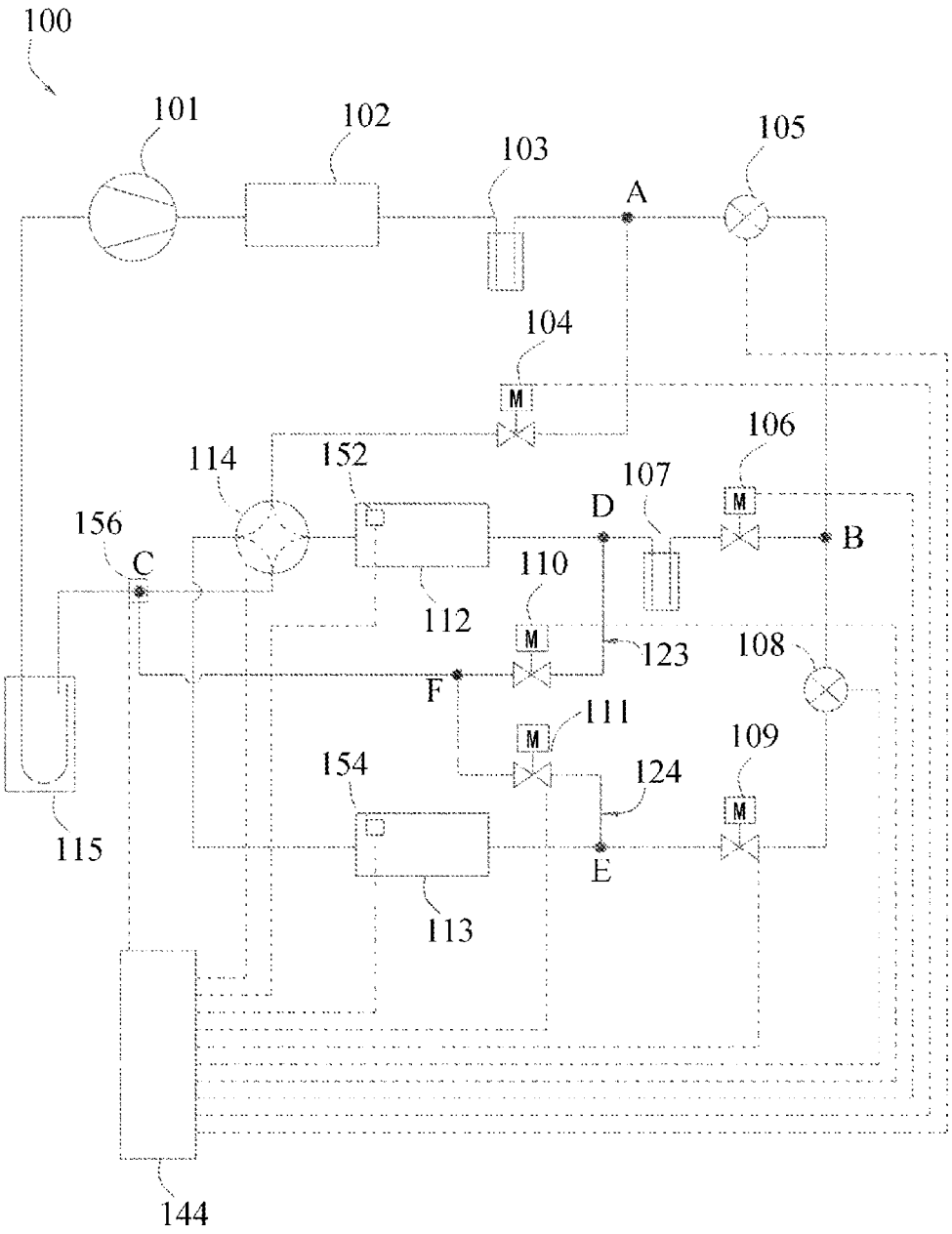
FIG. 1B is a schematic diagram of control components in the refrigeration system shown in FIG. 1A.

FIG. 1B is a schematic diagram of control components in the refrigeration system 100 shown in FIG. 1A. As shown in FIG. 1B, the refrigeration system 100 further comprises a first temperature detection device 152, a second temperature detection device 154 and a pressure detection device 156. The first temperature detection device 152 is disposed in the second heat exchanger 112, and configured to detect the temperature in the second heat exchanger 112. The second temperature detection device 154 is disposed in the third heat exchanger 113, and configured to detect the temperature in the third heat exchanger 113. The pressure detection device 156 is disposed at connection point C, and configured to detect a pressure of an operating system low-pressure side of the refrigeration system 100.

The refrigeration system 100 further comprises a control device 144. The control device 144 is in communicative connection with the first throttle valve 108, the second throttle valve 105, the path switching device 114, the third disconnection device 104, the fourth disconnection device 106, the fifth disconnection device 109, the first disconnection device 110, the second disconnection device 111, the pressure detection device 156, the first temperature detection device 152 and the second temperature detection device 154. The control device 144 is configured to be able to control the degree of opening of the first throttle valve 108 and second throttle valve 105 according to the different operating systems of the refrigeration system 100, and thereby control a pressure drop of refrigerant flowing through the first throttle valve 108 and second throttle valve 105. The control device 144 is configured to be able to control the switching of different paths in the path switching device 114 according to the different operating systems of the refrigeration system 100, and control the opening or closing of the third disconnection device 104, the fourth disconnection device 106 and the fifth disconnection device 109. The control device 144 is further configured to be able to control the opening or closing of the first disconnection device 110 and second disconnection device 111 according to a pressure value provided by the pressure detection device 156 and temperature values provided by the first temperature detection device 152 and second temperature detection device 154, and thereby control the connection and disconnection of the first discharge path 123 and second discharge path 124.

Figure 2:
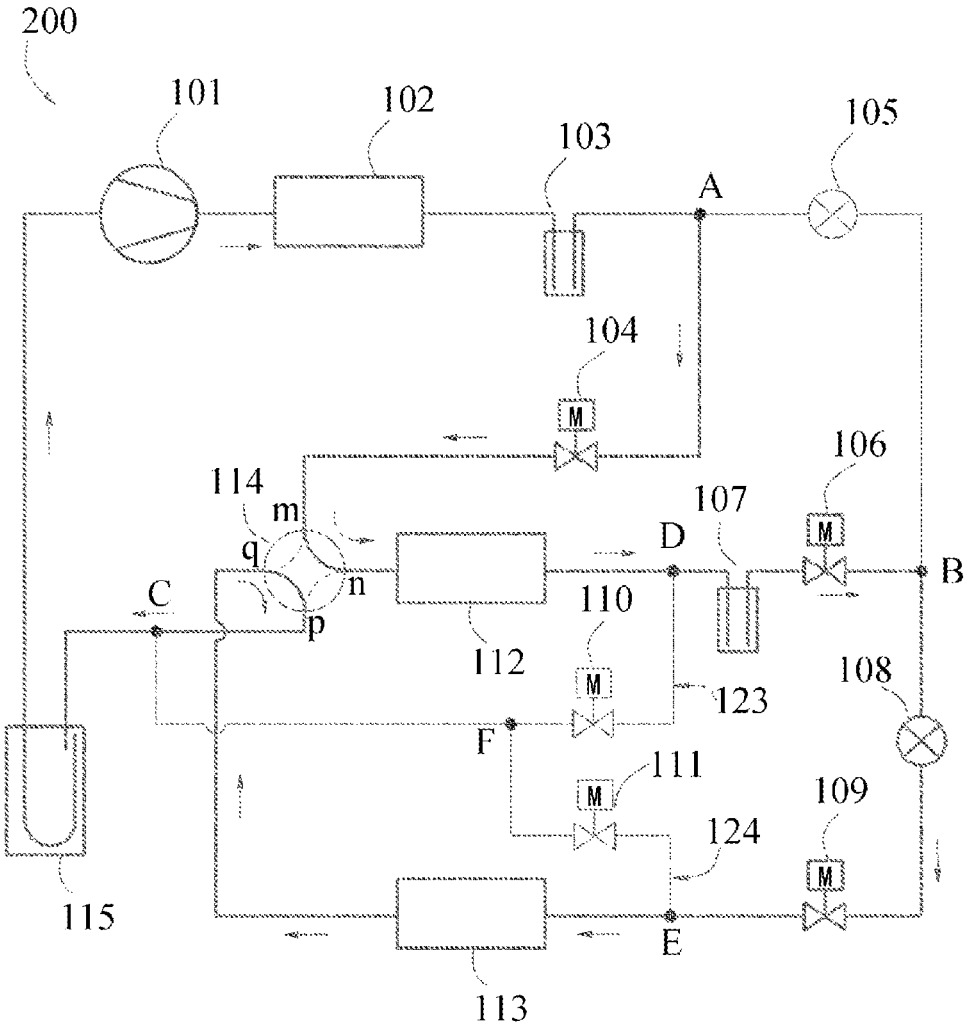
FIG. 2 shows a circulation path of a first series-connected path of the refrigeration system shown in FIG. 1A.

FIG. 2 shows a circulation path when the refrigeration system 100 shown in FIG. 1A is set to the first operating system. When the refrigeration system 100 is set to the first operating system, hot water can be supplied to a user end via the first heat exchanger 102, and cooling water for air conditioning/refrigeration can be supplied to the user end via the second heat exchanger 112. Specifically, when the refrigeration system 100 is set to the first operating system, a first series-connected path 200 can be formed. The third disconnection device 104, fourth disconnection device 106, fifth disconnection device 109 and first throttle valve 108 are in an open state; the second throttle valve 105, first disconnection device 110 and second disconnection device 111 are in a closed state; and in the path switching device 114, the first pair of controllable paths are connected and the second pair of controllable paths are disconnected. The arrows in FIG. 2 show the flow direction of refrigerant in the first series-connected path 200.

As shown in FIG. 2, the first series-connected path 200 sequentially connects the compressor 101, first heat exchanger 102, first liquid reservoir 103, third disconnection device 104, first controllable path mn, second heat exchanger 112, second liquid reservoir 107, fourth disconnection device 106, first throttle valve 108, fifth disconnection device 109, third heat exchanger 113, second controllable path pq and gas/liquid separator 115. At this time, the first heat exchanger 102, second heat exchanger 112 and third heat exchanger 113 are all in an operational state. The first heat exchanger 102 and second heat exchanger 112 act as condensers, and the third heat exchanger 113 acts as an evaporator.

Figure 3:
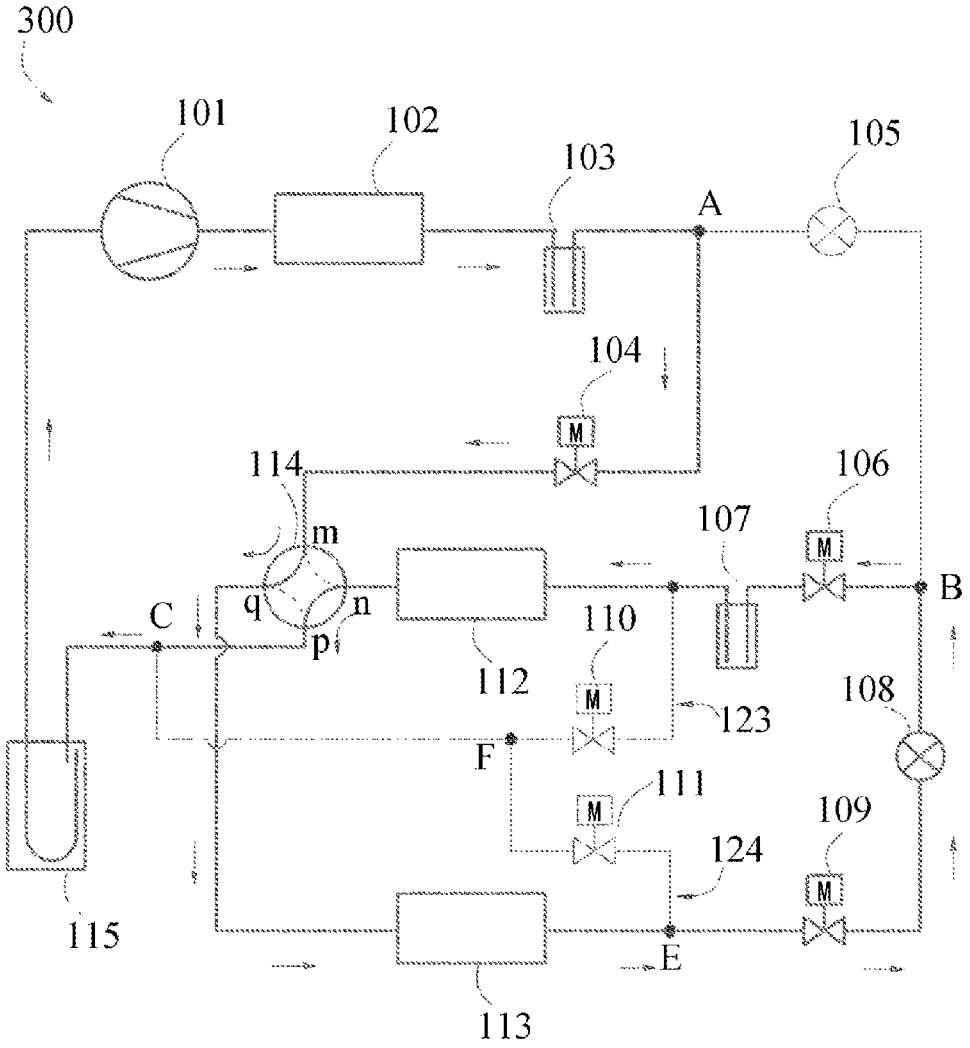
FIG. 3 shows a circulation path of a second series-connected path of the refrigeration system shown in FIG. 1A.

FIG. 3 shows a circulation path when the refrigeration system 100 shown in FIG. 1A is set to the second operating system. When the refrigeration system 100 is set to the second operating system, hot water can be supplied to the user end via the first heat exchanger 102, and hot water for air conditioning/heating can be supplied to the user end via the second heat exchanger 112. Specifically, when the refrigeration system 100 is set to the second operating system, a second series-connected path 300 can be formed. The third disconnection device 104, fourth disconnection device 106, fifth disconnection device 109 and first throttle valve 108 are in an open state; the second throttle valve 105, first disconnection device 110 and second disconnection device 111 are in a closed state; and in the path switching device 114, the second pair of controllable paths are connected and the first pair of controllable paths are disconnected. The arrows in FIG. 3 show the flow direction of refrigerant in the second series-connected path 300.

As shown in FIG. 3, the second series-connected path 300 can sequentially connect the compressor 101, first heat exchanger 102, first liquid reservoir 103, third disconnection device 104, third controllable path mq, third heat exchanger 113, fifth disconnection device 109, first throttle valve 108, fourth disconnection device 106, second liquid reservoir 107, second heat exchanger 112, fourth controllable path np and gas/liquid separator 115. At this time, the first heat exchanger 102, second heat exchanger 112 and third heat exchanger 113 are all in an operational state. The first heat exchanger 102 and third heat exchanger 113 act as condensers, and the second heat exchanger 112 acts as an evaporator.

When the refrigeration system 100 is set to the first operating system or second operating system, since the first heat exchanger 102, second heat exchanger 112 and third heat exchanger 113 are all in an operational state, there is no accumulation of refrigerant in non-operational heat exchangers in the first operating system and second operating system.

Figure 4:
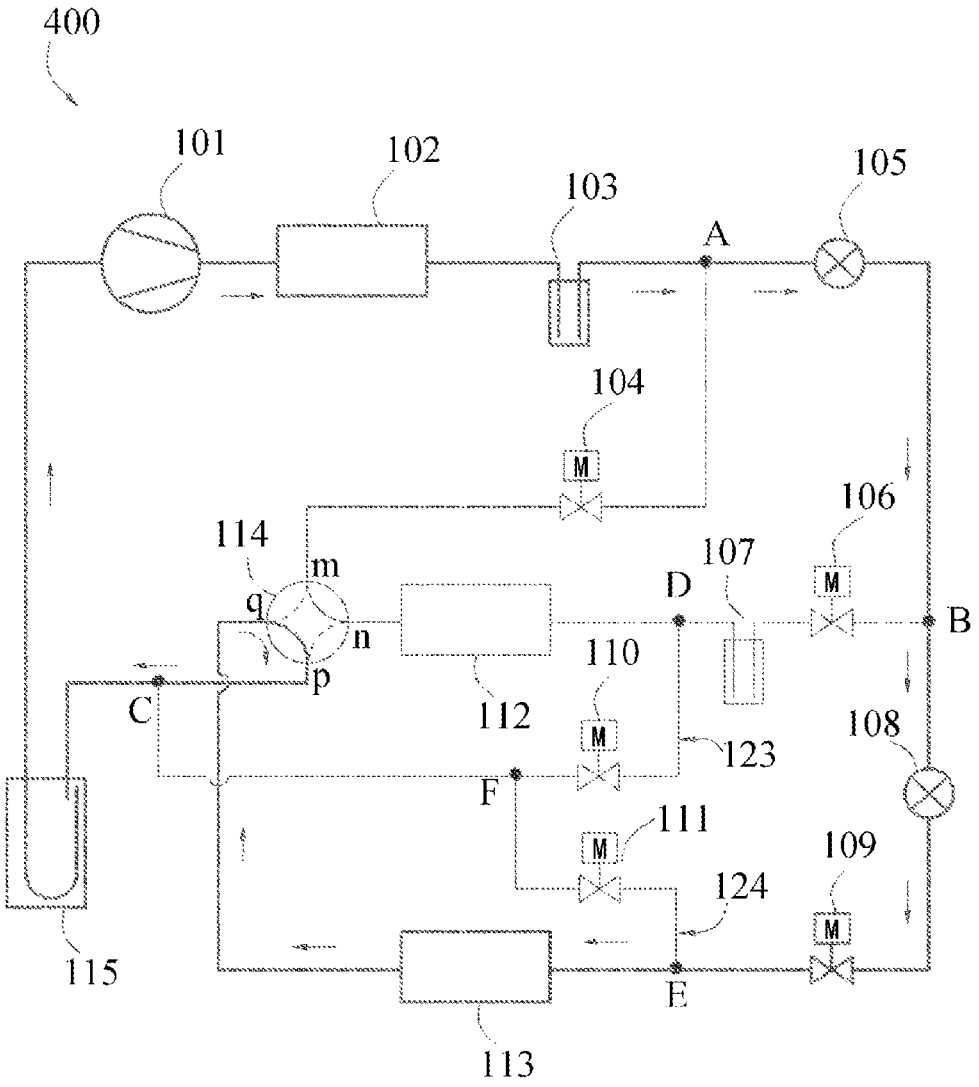
FIG. 4 shows a circulation path of a third series-connected path of the refrigeration system shown in FIG. 1A.

FIG. 4 shows a circulation path when the refrigeration system 100 shown in FIG. 1A is set to the third operating system. When the refrigeration system 100 is set to the third operating system, hot water can be supplied to the user end via the first heat exchanger 102. Specifically, when the refrigeration system 100 is set to the third operating system, a third series-connected path 400 can be formed. The fifth disconnection device 109, first throttle valve 108 and second throttle valve 105 are in an open state; the first disconnection device 110, second disconnection device 111, third disconnection device 104 and fourth disconnection device 106 are in a closed state; and in the path switching device 114, the first pair of controllable paths are connected and the second pair of controllable paths are disconnected. The arrows in FIG. 4 show the flow direction of refrigerant in the third series-connected path 400.

As shown in FIG. 4, the third series-connected path 400 sequentially connects the compressor 101, first heat exchanger 102, first liquid reservoir 103, second throttle valve 105, first throttle valve 108, fifth disconnection device 109, third heat exchanger 113, second controllable path pq and gas/liquid separator 115. The first heat exchanger 102 acts as a condenser, the third heat exchanger 113 acts as an evaporator, and the second heat exchanger 112 is in a non-operational state. Here, the statement "the second heat exchanger 112 is in a non-operational state" means: refrigerant can flow through the second heat exchanger 112, but refrigerant in the second heat exchanger 112 is not used for the heating or cooling of water supplied to the user end.

When the third operating system is running, since the second heat exchanger 112 is not operational, the temperature of a medium in the second heat exchanger 112 (i.e. water that participates in heat exchange in the second heat exchanger 112 and is supplied to the user end) will gradually approach the temperature of the environment in which the second heat exchanger 112 is located. When a saturation temperature corresponding to pressure in the second heat exchanger 112 is higher than the temperature of the medium in the second heat exchanger 112 or the environment in which it is located, the refrigerant in the second heat exchanger 112 will liquefy to liquid refrigerant, thereby causing the pressure in the second heat exchanger 112 to drop, with the result that gaseous refrigerant in the third series-connected path 400 continuously migrates to the non-operational second heat exchanger 112, and is continuously converted to liquid refrigerant that accumulates therein. This will result in a reduction in the amount of refrigerant moving in the third series-connected path 400, thereby affecting the normal operation of the refrigeration system 100.

Thus, when the third operating system is running, the pressure of the operating system low-pressure side (i.e. at point C) is detected by means of the pressure detection device 156, and the temperature in the second heat exchanger 112 is detected by means of the first temperature detection device 152. Saturation temperatures corresponding to different pressures of refrigerant are stored in the control device 144; thus, based on the pressure value detected by the pressure detection device 156, the saturation temperature of the refrigerant at this pressure can be obtained. When the saturation temperature of refrigerant corresponding to the pressure of the operating system low-pressure side (i.e. at point C) is lower than the temperature in the second heat exchanger 112 as detected by the first temperature detection device 152, the pressure of the operating system low-pressure side (i.e. at point C) is also lower than the pressure in the second heat exchanger 112, and the control device 144 will open the first disconnection device 110, thus connecting the first discharge path 123, and thereby enabling the refrigerant that has accumulated inside the second heat exchanger 112 to migrate towards the operating system low-pressure side of the refrigeration system 100 due to the pressure difference. When the saturation temperature of refrigerant corresponding to the pressure of the operating system low-pressure side (i.e. at point C) is not lower than the temperature in the second heat exchanger 112 as detected by the first temperature detection device 152, the control device 144 will reduce the degree of opening of the second throttle valve 105 and/or first throttle valve 108, such that the pressure of the operating system low-pressure side (i.e. point C) drops, so that the pressure of the operating system low-pressure side (i.e. at point C) is lower than the pressure in the second heat exchanger 112, at which time the saturation temperature corresponding to the pressure of the operating system low-pressure side (i.e. point C) is also lower than the temperature in the second heat exchanger 112. The control device 144 then opens the first disconnection device 110, thus connecting the first discharge path 123, and thereby enabling the refrigerant that has accumulated inside the second heat exchanger 112 to migrate towards the operating system low-pressure side due to the pressure difference. After discharge has taken place through the first discharge path 123 for a period of time, the pressure of the operating system low-pressure side (i.e. at point C) is the same as the pressure in the second heat exchanger 112, i.e. the saturation temperature corresponding to the pressure of the operating system low-pressure side (i.e. point C) is the same as the temperature in the second heat exchanger 112; at this time, the control device 144 disconnects the first discharge path 123 by closing the first disconnection device 110. In some embodiments, the control device 144 closes the first disconnection device 110 when the first discharge path 123 has been connected (i.e. refrigerant inside the second heat exchanger 112 has been discharged) for 2-5 minutes.

The arrangement described above enables refrigerant that has accumulated inside the second heat exchanger 112 to migrate into the third series-connected path 400 of the third operating system, thereby avoiding shortage of refrigerant in the operating system when the refrigeration system 100 is running in the third operating system.

It can be seen from FIGS. 2 and 4 that the first operating system and third operating system can be implemented by opening and closing the third disconnection device 104, fourth disconnection device 106 and second throttle valve 105. Specifically, taking the first series-connected path 200 as a starting configuration, the third disconnection device 104 and fourth disconnection device 106 are closed and the second throttle valve 105 is opened, such that the sequential connection of the compressor 101, first heat exchanger 102, first liquid reservoir 103, second throttle valve 105, first throttle valve 108, fifth disconnection device 109, third heat exchanger 113, second controllable path pq and gas/liquid separator 115 is maintained while the second heat exchanger 112 is separated from the first series-connected path 200, thereby switching the first series-connected path 200 to the third series-connected path 400.

Figure 5:
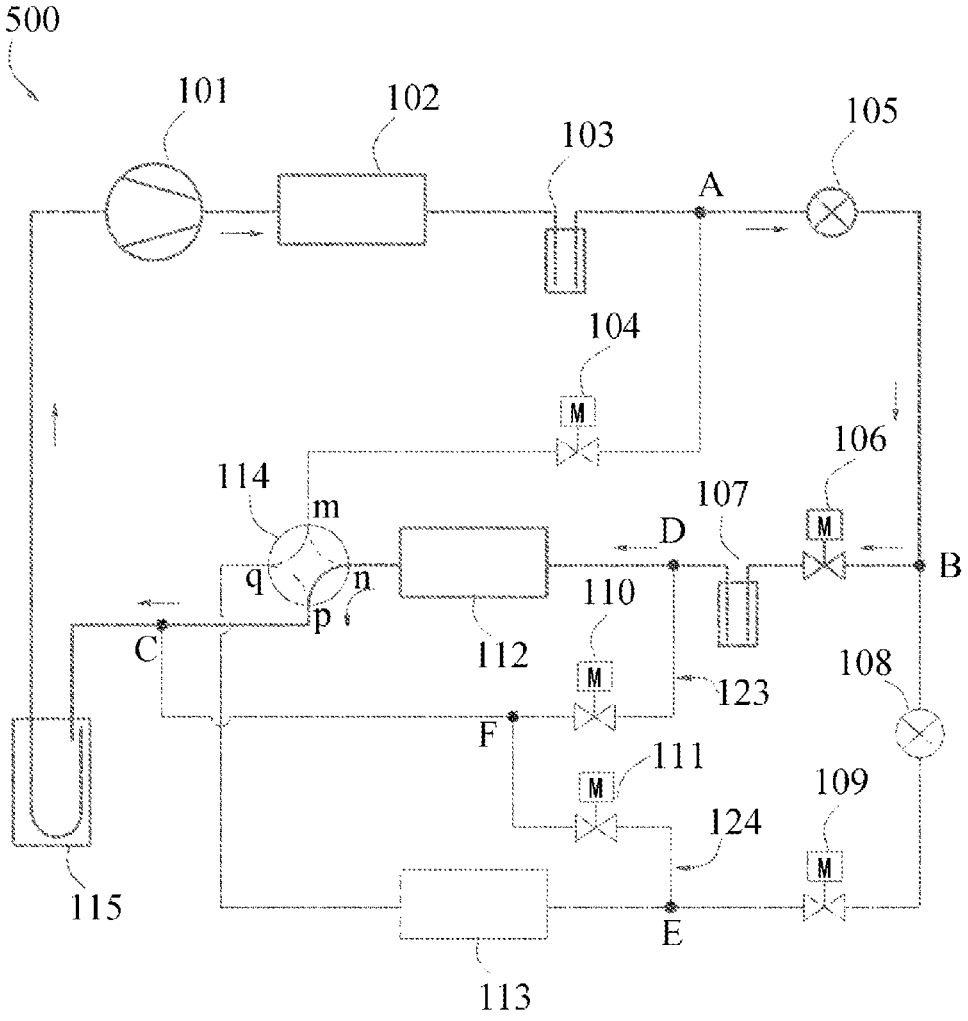
FIG. 5 shows a circulation path of a fourth series-connected path of the refrigeration system shown in FIG. 1A.

FIG. 5 shows a circulation path when the refrigeration system 100 shown in FIG. 1A is set to the fourth operating system. When the refrigeration system 100 is set to the fourth operating system, hot water can be supplied to the user end via the first heat exchanger 102, and cooling water for air conditioning/cooling can be supplied to the user end via the second heat exchanger 112. Specifically, when the refrigeration system 100 is set to the fourth operating system, a fourth series-connected path 500 can be formed. The fourth disconnection device 106 and second throttle valve 105 are in an open state; the third disconnection device 104, fifth disconnection device 109, first disconnection device 110, second disconnection device 111 and first throttle valve 108 are in a closed state; and in the path switching device 114, the second pair of controllable paths are connected and the first pair of controllable paths are disconnected. The arrows in FIG. 5 show the flow direction of refrigerant in the fourth series-connected path 500.

As shown in FIG. 5, the fourth series-connected path 500 can sequentially connect the compressor 101, first heat exchanger 102, first liquid reservoir 103, second throttle valve 105, fourth disconnection device 106, second liquid reservoir 107, second heat exchanger 112, fourth controllable path np and gas/liquid separator 115. The first heat exchanger 102 acts as a condenser, the second heat exchanger 112 acts as an evaporator, and the third heat exchanger 113 is in a non-operational state. Here, the statement "the third heat exchanger 113 is in a non-operational state" means: refrigerant can flow through the third heat exchanger 113, but refrigerant in the third heat exchanger 113 is not used for the heating or cooling of external air.

When the fourth operating system is running, since the third heat exchanger 113 is not operational, the temperature of a medium in the third heat exchanger 113 (i.e. air that participates in heat exchange in the third heat exchanger 113) will gradually approach the temperature of the environment in which the third heat exchanger 113 is located. When a saturation temperature corresponding to pressure in the third heat exchanger 113 is higher than the temperature of the air medium in the third heat exchanger 113 or the environment in which it is located, the refrigerant in the third heat exchanger 113 will liquefy to liquid refrigerant, thereby causing the pressure in the third heat exchanger 113 to drop, with the result that gaseous refrigerant in the fourth series-connected path 500 continuously migrates to the non-operational third heat exchanger 113, and is continuously converted to liquid refrigerant that accumulates therein. This will result in a reduction in the amount of refrigerant moving in the fourth series-connected path 500, thereby affecting the normal operation of the refrigeration system 100.

Thus, when the fourth operating system is running, the pressure of the operating system low-pressure side (i.e. at point C) is detected by means of the pressure detection device 156, and the temperature in the third heat exchanger 113 is detected by means of the second temperature detection device 154. Saturation temperatures corresponding to different pressures of refrigerant are stored in the control device 144; thus, based on the pressure value detected by the pressure detection device 156, the saturation temperature of the refrigerant at this pressure can be obtained. When the saturation temperature of refrigerant corresponding to the pressure of the operating system low-pressure side (i.e. at point C) is lower than the temperature in the third heat exchanger 113 as detected by the second temperature detection device 154, the pressure of the operating system low-pressure side (i.e. at point C) is also lower than the pressure in the third heat exchanger 113, and the control device 144 will open the second disconnection device 111, thus connecting the second discharge path 124, and thereby enabling the refrigerant that has accumulated inside the third heat exchanger 113 to migrate towards the operating system low-pressure side due to the pressure difference. When the saturation temperature of refrigerant corresponding to the pressure of the operating system low-pressure side (i.e. at point C) is not lower than the temperature in the third heat exchanger 113 as detected by the second temperature detection device 154, the control device 144 will reduce the degree of opening of the second throttle valve 105, such that the pressure of the operating system low-pressure side (i.e. point C) drops, so that the pressure of the operating system low-pressure side (i.e. at point C) is lower than the pressure in the third heat exchanger 113, at which time the saturation temperature corresponding to the pressure of the operating system low-pressure side (i.e. point C) is also lower than the temperature in the third heat exchanger 113. The control device 144 then opens the second disconnection device 111, thus connecting the second discharge path 124, and thereby enabling the refrigerant that has accumulated inside the third heat exchanger 113 to migrate towards the operating system low-pressure side due to the pressure difference. After discharge has taken place through the second discharge path 124 for a period of time, the pressure of the operating system low-pressure side (i.e. point C) is the same as the pressure in the third heat exchanger 113, i.e. the saturation temperature corresponding to the pressure of the operating system low-pressure side (i.e. point C) is the same as the temperature in the third heat exchanger 113; at this time, the control device 144 disconnects the second discharge path 124 by closing the second disconnection device 111. In some embodiments, the control device 144 closes the second disconnection device 111 when the second discharge path 124 has been connected (i.e. refrigerant inside the third heat exchanger 113 has been discharged) for 2-5 minutes.

The arrangement described above enables refrigerant that has accumulated inside the third heat exchanger 113 to migrate into the fourth series-connected path 500 of the fourth operating system, thereby avoiding shortage of refrigerant in the operating system when the refrigeration system 100 is running in the fourth operating system.

It can be seen from FIGS. 3 and 5 that the second operating system and fourth operating system can be implemented by opening and closing the third disconnection device 104, fifth disconnection device 109 and second throttle valve 105. Specifically, taking the second series-connected path 300 as a starting configuration, the third disconnection device 104 and fifth disconnection device 109 are closed and the second throttle valve 105 is opened, such that the sequential connection of the compressor 101, first heat exchanger 102, first liquid reservoir 103, second throttle valve 105, fourth disconnection device 106, second liquid reservoir 107, second heat exchanger 112, fourth controllable path np and gas/liquid separator 115 is maintained while the third heat exchanger 113 is separated from the second series-connected path 300, thereby switching the second series-connected path 300 to the fourth series-connected path 500.

It must be explained that although the fifth disconnection device 109 and first throttle valve 108 are provided in the refrigeration system 100, due to the fact that the fifth disconnection device 109 and first throttle valve 108 are connected in series and the first throttle valve 108 is configured such that the degree of opening thereof (i.e. the flow rate through the first throttle valve 108) can be controlled, it is also possible to omit the fifth disconnection device 109, and realize the opening and closing functions of the fifth disconnection device 109 through the opening and closing of the first throttle valve 108.

Figure 6A:
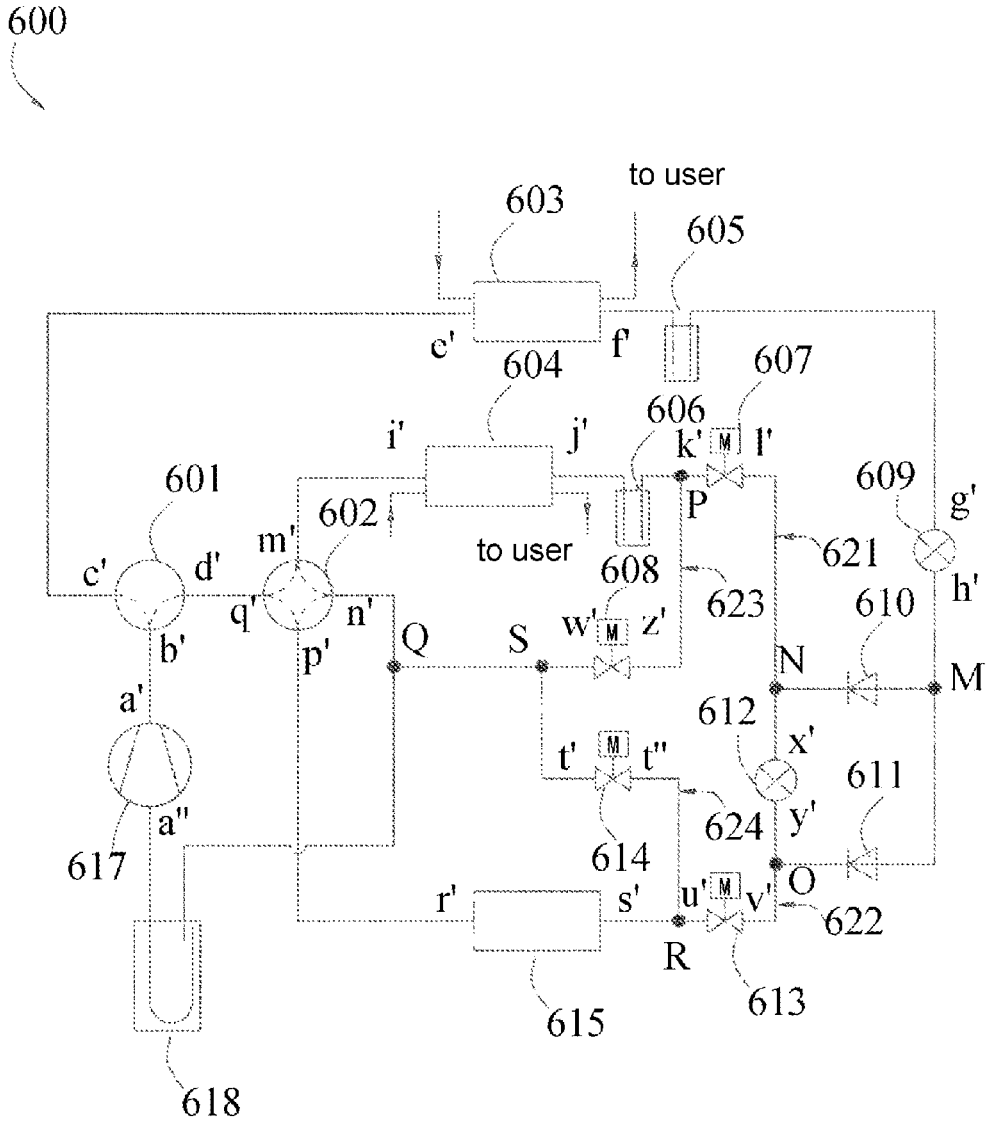
FIG. 6A shows a refrigeration system in a second embodiment of the present application.

FIG. 6A shows a refrigeration system 600 in a second embodiment of the present application. As shown in FIG. 6A, the refrigeration system 600 comprises a compressor 617, a first heat exchanger 603, a second heat exchanger 604, a third heat exchanger 615, a first throttle valve 609, a second throttle valve 612, a first liquid reservoir 605, a second liquid reservoir 606 and a gas/liquid separator 618. The compressor 617 is configured to compress refrigerant to a high-temperature, high-pressure fluid. The first heat exchanger 603 and second heat exchanger 604 are both water-side heat exchangers. When refrigerant flows through the first heat exchanger 603 and second heat exchanger 604, it can exchange heat with a water medium in the first heat exchanger 603 and second heat exchanger 604 that is supplied to a user, such that the temperature of the refrigerant rises or falls. The third heat exchanger 615 in the present application is a wind-side heat exchanger. When refrigerant flows through the third heat exchanger 615, it can exchange heat with external air via the third heat exchanger 615, so that the temperature of the refrigerant rises or falls. The first liquid reservoir 605 and second liquid reservoir 606 are configured to store refrigerant in the refrigeration system 600. The gas/liquid separator 618 is configured to separate gaseous refrigerant and liquid refrigerant entering the gas/liquid separator 618, so that the refrigerant which flows out of the gas/liquid separator 618 is gaseous refrigerant.

The refrigeration system 600 further comprises a switch structure, configured to enable the refrigeration system 600 to switch among different operating systems. The switch structure comprises a first switching assembly 601, a second switching assembly 602, a sixth disconnection device 607 and a seventh disconnection device 613. Specifically, the sixth disconnection device 607 and seventh disconnection device 613 are solenoid valves. The first switching assembly 601 is a three-way valve having three ports b', c' and d', and the three-way valve has a first three-way controllable path b'c' and a second three-way controllable path b'd'. Specifically, the first three-way controllable path b'c' can connect ports b' and c', and the second three-way controllable path b'd' can connect ports b' and d'.

The second switching assembly 602 is a four-way valve having a total of four ports, specifically a first port m', a second port n', a third port p' and a fourth port q'. Moreover, the four-way valve is provided with a first set of control paths and a second set of control paths. The first set of control paths comprises a first control path m'n' and a second control path p'q'. The first control path m'n' can connect the first port m' with the second port n', and the second control path p'q' can connect the third port p' with the fourth port q'. The second set of control paths comprises a third control path m'q' and a fourth control path n'p'. The third control path m'q' can connect the first port m' with the fourth port q', and the fourth control path n'p' can connect the second port n' with the third port p'.

The refrigeration system 600 further comprises a first one-way valve 610 and a second one-way valve 611, for ensuring that refrigerant flows in a single direction in circulation pipelines in which the first one-way valve 610 and second one-way valve 611 are located.

As shown in FIG. 6A, the various components mentioned above are connected by connecting pipelines to form the refrigeration system 600. Specifically, the port c' of the first switching assembly 601 is connected to an end e' of the first heat exchanger 603, another end f of the first heat exchanger 603 is connected to an end g' of the first throttle valve 609, another end h' of the first throttle valve 609 is connected to an inlet end of the first one-way valve 610, an outlet end of the first one-way valve 610 is connected to an end l' of the sixth disconnection device 607, another end k' of the sixth disconnection device 607 is connected to an end j' of the second heat exchanger 604, and another end i' of the second heat exchanger 604 is connected to the first port m' of the second switching assembly 602. The first liquid reservoir 605 is disposed on the connecting pipeline between the other end f' of the first heat exchanger 603 and the end g' of the first throttle valve 609. The second liquid reservoir 606 is disposed on the connecting pipeline between the other end k' of the sixth disconnection device 607 and the end j' of the second heat exchanger 604. The port b' of the first switching assembly 601 is connected to a gas discharge end a' of the compressor 617, a gas suction end a" of the compressor 617 is in communication with the second port n' of the second switching assembly 602, and the gas/liquid separator 115 is disposed between connecting pipelines of the gas suction end a" of the compressor 617 and the second port n' of the second switching assembly 602.

The third port p' of the second switching assembly 602 is connected to an end r' of the third heat exchanger 615, another end s' of the third heat exchanger 615 is connected to an end u' of the seventh disconnection device 613, another end v' of the seventh disconnection device 613 is connected to an outlet end of the second one-way valve 611, and an inlet end of the second one-way valve 611 is connected at a connection point M between the other end h' of the first throttle valve 609 and the inlet end of the first one-way valve 610. An end x' of the second throttle valve 612 is connected at a connection point N between the outlet end of the first one-way valve 610 and the end l' of the sixth disconnection device 607; another end y' of the second throttle valve 612 is connected at a connection point O between the other end v' of the seventh disconnection device 613 and the outlet end of the second one-way valve 611.

The fourth port q' of the second switching assembly 602 is connected to the port d' of the first switching assembly 601.

The refrigeration system 600 further comprises a discharge path. Specifically, the discharge path comprises a first discharge path 623 and a second discharge path 624. The first discharge path 623 and second discharge path 624 can be controllably connected or disconnected by a discharge switch device. As an example, the discharge switch device comprises a first disconnection device 608 and a second disconnection device 614. The first disconnection device 608 and second disconnection device 614 are solenoid valves.

One end of the first discharge path 623 is connected at a connection point P between the second liquid reservoir 606 and the sixth disconnection device 607; another end of the first discharge path 623 is connected at a connection point Q between the gas/liquid separator 618 and the second port n' of the second switching assembly 602. The first disconnection device 608 is disposed on the first discharge path 623. One end of the second discharge path 624 is connected at a connection point R between the third heat exchanger 615 and the seventh disconnection device 613; another end of the second discharge path 624 is connected at a connection point S between the connection point Q and the first disconnection device 608. The second disconnection device 614 is disposed on the second discharge path 624.

The refrigeration system 600 shown in FIG. 6A can realize four operating systems, comprising a fifth operating system, a sixth operating system, a seventh operating system and an eighth operating system, through the cooperation of the switch structure, the first throttle valve 609 and the second throttle valve 612.

When the refrigeration system 600 is set to the fifth operating system and the sixth operating system, the second three-way controllable path b'd' in the first switching assembly 601 is connected and the first three-way controllable path b'c' is disconnected. When the refrigeration system 600 is set to the seventh operating system and the eighth operating system, the first three-way controllable path b'c' in the first switching assembly 601 is connected and the second three-way controllable path b'd' is disconnected.

When the refrigeration system 600 is set to the fifth operating system and the seventh operating system, the first set of control paths in the second switching assembly 602 are connected and the second set of control paths are disconnected. When the refrigeration system 600 is set to the sixth operating system and the eighth operating system, the second set of control paths in the second switching assembly 602 are connected and the first set of control paths are disconnected.

Figure 6B:
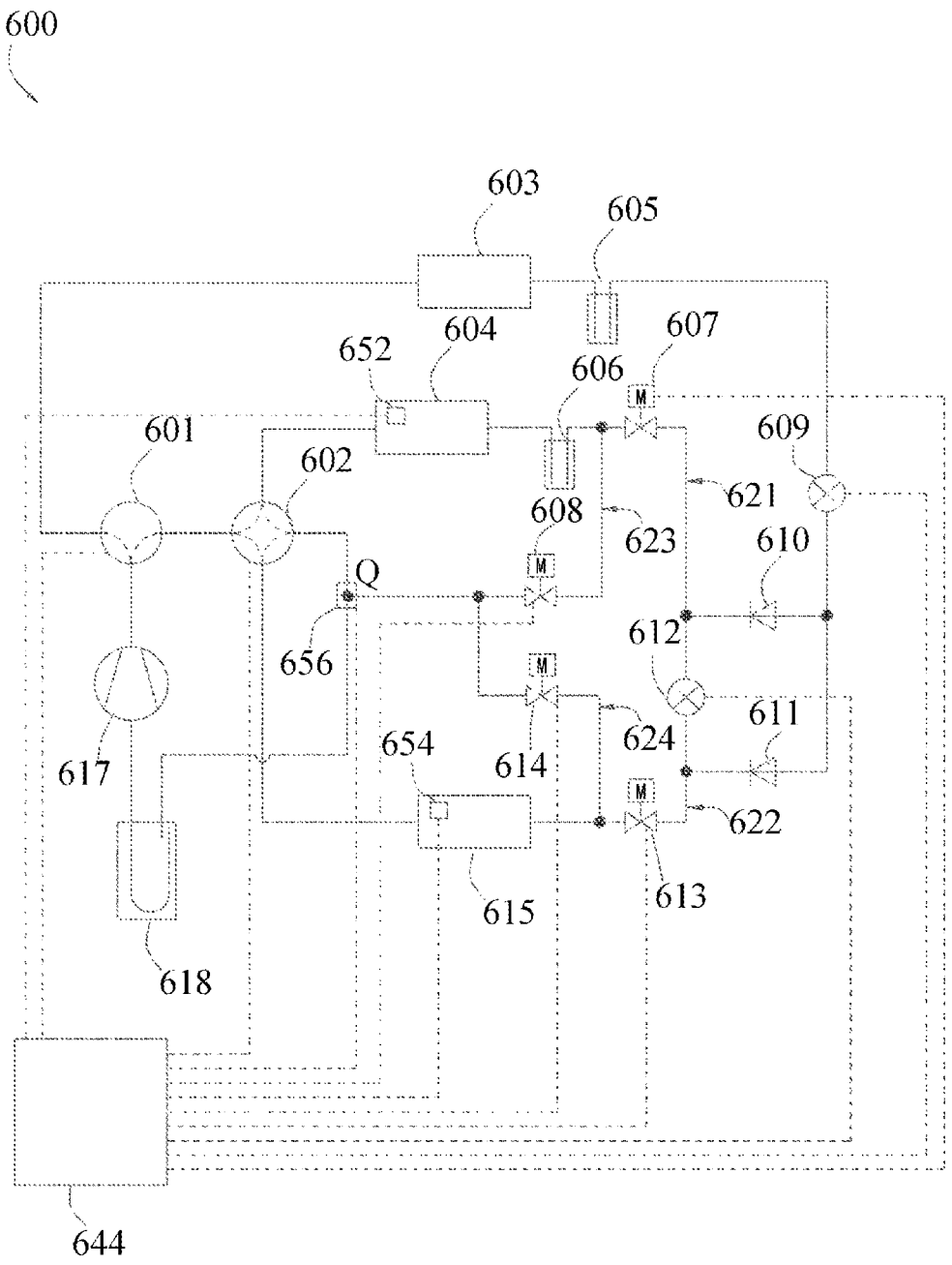
FIG. 6B is a schematic diagram of control components in the refrigeration system shown in FIG. 6A.

FIG. 6B is a schematic diagram of control components in the refrigeration system 600 shown in FIG. 6A. As shown in FIG. 6B, the refrigeration system 600 further comprises a first temperature detection device 652, a second temperature detection device 654 and a pressure detection device 656. The first temperature detection device 652 is disposed in the second heat exchanger 604, and configured to detect the temperature in the second heat exchanger 604. The second temperature detection device 654 is disposed in the third heat exchanger 615, and configured to detect the temperature in the third heat exchanger 615. The pressure detection device 656 is disposed at connection point Q, and configured to detect a pressure of an operating system low-pressure side of the refrigeration system 600.

The refrigeration system 600 further comprises a control device 644. The control device 644 is in communicative connection with the first throttle valve 609, second throttle valve 612, first switching assembly 601, second switching assembly 602, sixth disconnection device 607, seventh disconnection device 613, first disconnection device 608, second disconnection device 614, pressure detection device 656, first temperature detection device 652 and second temperature detection device 654. The control device 644 is configured to be able to control the degree of opening of the first throttle valve 609 and second throttle valve 612 according to the different operating systems of the refrigeration system 600, and thereby control a pressure drop of refrigerant flowing through the first throttle valve 609 and second throttle valve 612. The control device 644 is configured to be able to control the switching of different paths in the first switching assembly 601 and second switching assembly 602 according to the different operating systems of the refrigeration system 600, and control the opening or closing of the sixth disconnection device 607 and the seventh disconnection device 613. The control device 644 is further configured to be able to control the opening or closing of the first disconnection device 608 and second disconnection device 614 according to a pressure value provided by the pressure detection device 656 and temperature values provided by the first temperature detection device 652 and second temperature detection device 654, and thereby control the connection and disconnection of the first discharge path 623 and second discharge path 624.

Figure 7:
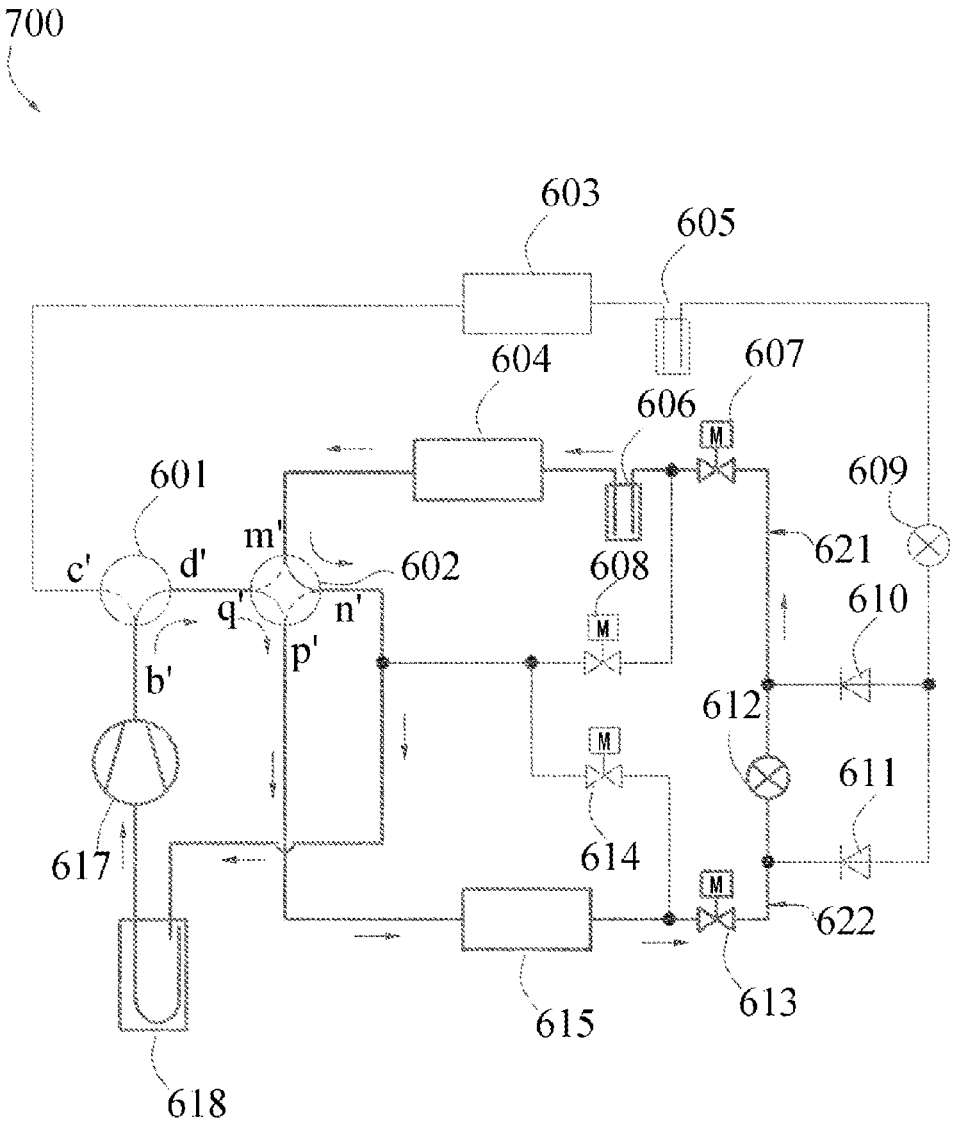
FIG. 7 shows a circulation path of a fifth series-connected path of the refrigeration system shown in FIG. 6.

FIG. 7 shows a circulation path when the refrigeration system 600 shown in FIG. 6A is set to the fifth operating system. When the refrigeration system 600 is set to the fifth operating system, cooling water for air conditioning/refrigeration can be supplied to the user end via the second heat exchanger 604. Specifically, when the refrigeration system 600 is set to the fifth operating system, a fifth series-connected path 700 can be formed. The sixth disconnection device 607, seventh disconnection device 613 and second throttle valve 612 are in an open state; the first disconnection device 608 and second disconnection device 614 are in a closed state; the second three-way controllable path b'd' in the first switching assembly 601 is connected and the first three-way controllable path b'c' is disconnected; and the first set of control paths in the second switching assembly 602 are connected and the second set of control paths are disconnected. The first one-way valve 610 and second one-way valve 611 can prevent the flow of fluid from the outlet end of the one-way valve towards the inlet end. The arrows in FIG. 7 show the flow direction of refrigerant in the fifth series-connected path 700.

As shown in FIG. 7, the fifth series-connected path 700 sequentially connects the compressor 617, second three-way controllable path b'd', second controllable path p'q', third heat exchanger 615, seventh disconnection device 613, second throttle valve 612, sixth disconnection device 607, second liquid reservoir 606, second heat exchanger 604, first controllable path m'n' and gas/liquid separator 618. At this time, the third heat exchanger 615 acts as a condenser, the second heat exchanger 604 acts as an evaporator, and the first heat exchanger 603 is in a non-operational state.

Figure 8:
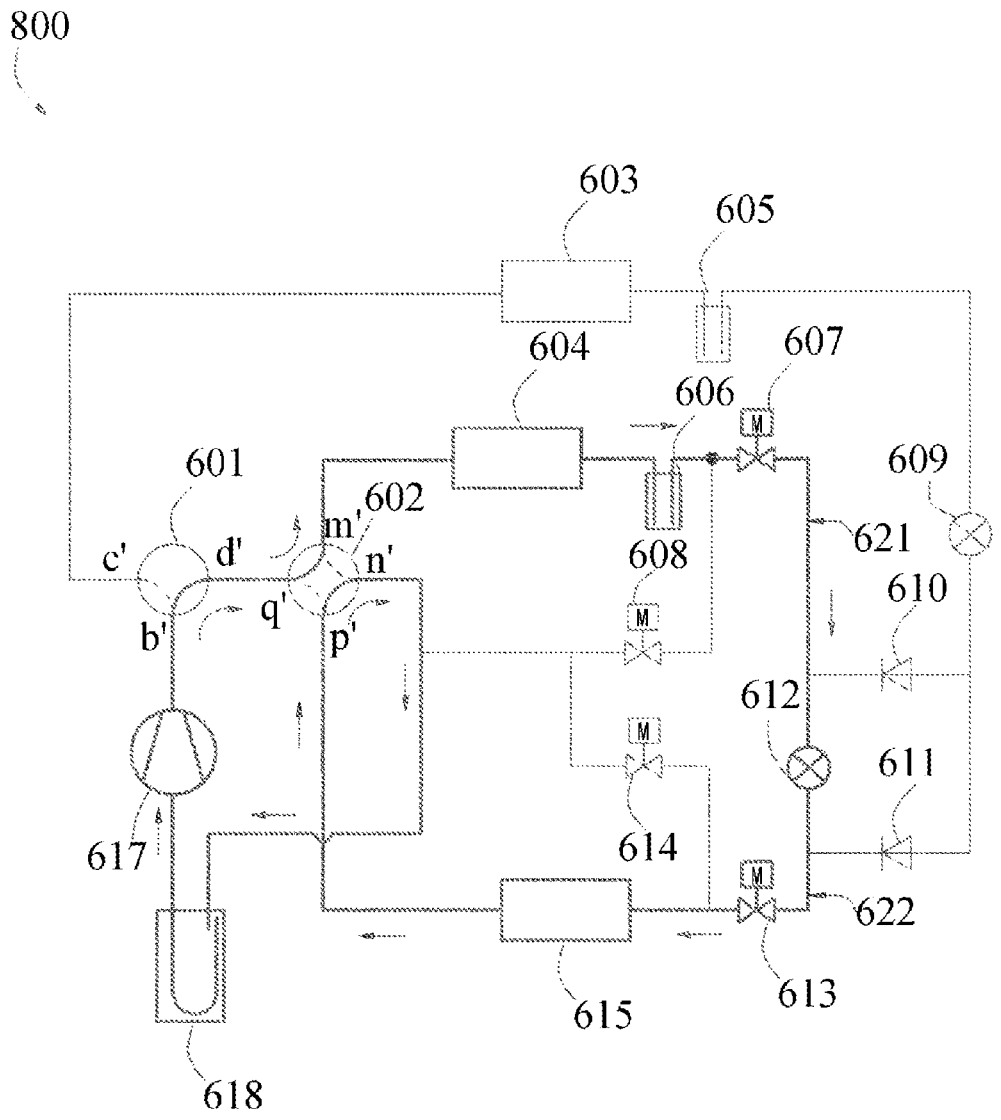
FIG. 8 shows a circulation path of a sixth series-connected path of the refrigeration system shown in FIG. 6.

FIG. 8 shows a circulation path when the refrigeration system 600 shown in FIG. 6A is set to the sixth operating system. When the refrigeration system 600 is set to the sixth operating system, hot water for air conditioning/heating can be supplied to the user end via the second heat exchanger 604. Specifically, when the refrigeration system 600 is set to the sixth operating system, a sixth series-connected path 800 can be formed. The sixth disconnection device 607, seventh disconnection device 613 and second throttle valve 612 are in an open state; the first disconnection device 608 and second disconnection device 614 are in a closed state; the second three-way controllable path b'd' in the first switching assembly 601 is connected and the first three-way controllable path b'c' is disconnected; and the second set of control paths in the second switching assembly 602 are connected and the first set of control paths are disconnected. The first one-way valve 610 and second one-way valve 611 can prevent the flow of fluid from the outlet end of the one-way valve towards the inlet end. The arrows in FIG. 8 show the flow direction of refrigerant in the sixth series-connected path 800.

As shown in FIG. 8, the sixth series-connected path 800 sequentially connects the compressor 617, the second three-way controllable path b'd', the third controllable path m'q', the second heat exchanger 604, the second liquid reservoir 606, the sixth disconnection device 607, the second throttle valve 612, the seventh disconnection device 613, the third heat exchanger 615, the fourth control path n'p' and the gas/liquid separator 618. At this time, the second heat exchanger 604 acts as a condenser, the third heat exchanger 615 acts as an evaporator, and the first heat exchanger 603 is in a non-operational state.

When the refrigeration system 600 is set to the fifth operating system or sixth operating system, the first heat exchanger 603 is in a non-operational state. The statement "the first heat exchanger 603 is in a non-operational state" means: refrigerant can flow through the first heat exchanger 603, but refrigerant in the first heat exchanger 603 is not used for the heating or cooling of water supplied to the user end. However, since the first heat exchanger 603 is used to supply hot water to the user side, the temperature of the medium of the first heat exchanger 603 is high. As an example, in the present application, the temperature of the medium in the first heat exchanger 603 is higher than a saturation temperature corresponding to the pressure inside the first heat exchanger 603; thus, there is no condensation and consequent accumulation of refrigerant in the first heat exchanger 603. Therefore, in an embodiment of the present application, no discharge path is provided between the first heat exchanger 603 in the refrigeration system 600 and the operating system low-pressure side of the refrigeration system 600.

It can be seen from FIGS. 7 and 8 that the fifth operating system and sixth operating system can be implemented by path switching in the second switching assembly 602. Specifically, the fifth series-connected path 700 can be switched to the sixth series-connected path 800 by switching the second switching assembly 602 from a configuration in which the first pair of controllable paths are connected, to a configuration in which the second pair of controllable paths are connected.

It must be explained that although the first one-way valve 610 and second one-way valve 611 are provided in the refrigeration system 600 to control the flow of refrigerant so as to form the fifth series-connected path 700 and sixth series-connected path 800, those skilled in the art will understand that another device such as a solenoid valve or pump could also be used to realize the connection and disconnection functions of the first one-way valve 610 and second one-way valve 611.

Figure 9:
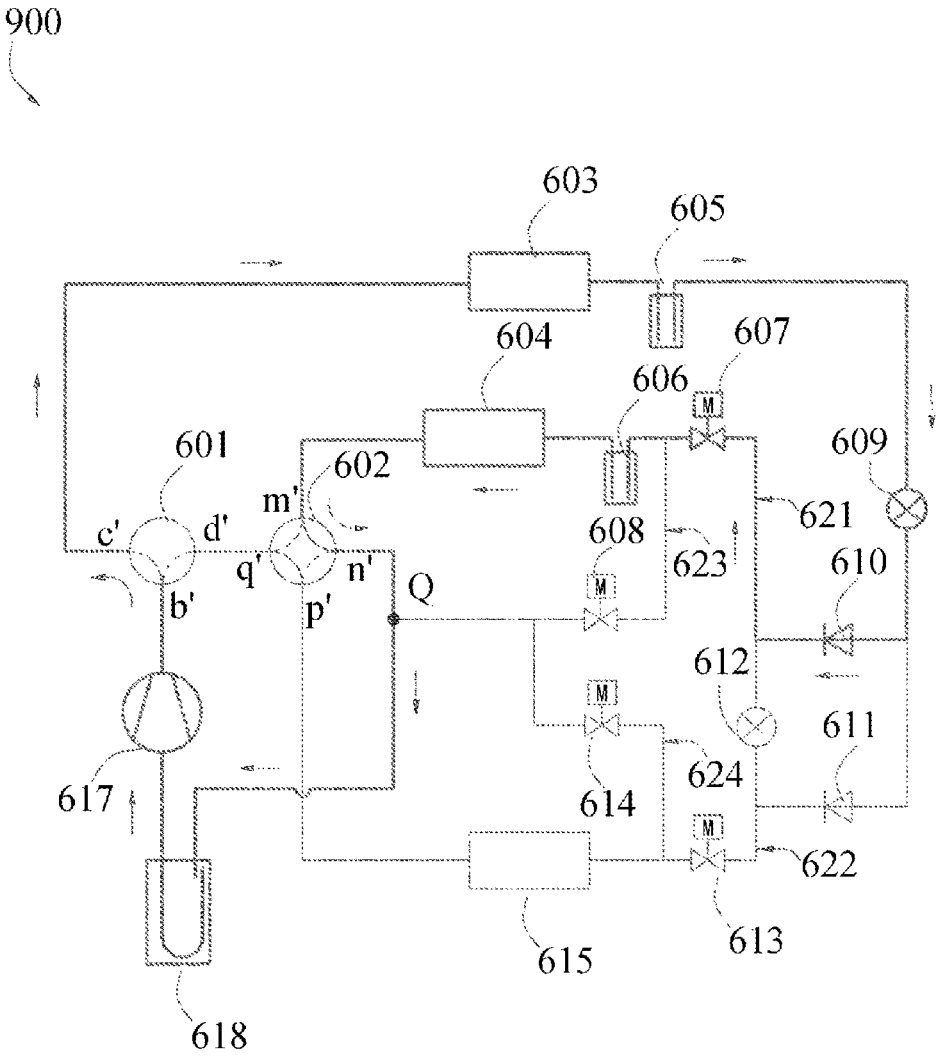
FIG. 9 shows a circulation path of a seventh series-connected path of the refrigeration system shown in FIG. 6.

FIG. 9 shows a circulation path when the refrigeration system 600 shown in FIG. 6A is set to the seventh operating system. When the refrigeration system 600 is set to the seventh operating system, hot water can be supplied to the user end via the first heat exchanger 603, and cooling water for air conditioning/refrigeration can be supplied to the user end via the second heat exchanger 604. Specifically, when the refrigeration system 600 is set to the seventh operating system, a seventh series-connected path 900 can be formed. The sixth disconnection device 607 and first throttle valve 609 are in an open state; the second throttle valve 612, seventh disconnection device 613, first disconnection device 608 and second disconnection device 614 are in a closed state. In the first switching assembly 601, the first three-way controllable path b'c' is connected and the second three-way controllable path b'd' is disconnected; and in the second switching assembly 602, the first set of control paths are connected and the second set of control paths are disconnected. The arrows in FIG. 9 show the flow direction of refrigerant in the seventh series-connected path 900.

As shown in FIG. 9, the seventh series-connected path 900 sequentially connects the compressor 617, first three-way controllable path b'c', first heat exchanger 603, first liquid reservoir 605, first throttle valve 609, first one-way valve 610, sixth disconnection device 607, second liquid reservoir 606, second heat exchanger 604, first control path m'n' and gas/liquid separator 618. The first heat exchanger 603 acts as a condenser, the second heat exchanger 604 acts as an evaporator, and the third heat exchanger 615 is in a non-operational state. The statement "the third heat exchanger 615 is in a non-operational state" means: refrigerant can flow through the third heat exchanger 615, but refrigerant in the third heat exchanger 615 is not used for the heating or cooling of external air.

When the seventh operating system is running, since the third heat exchanger 615 is not operational, the temperature of a medium in the third heat exchanger 615 (i.e. air that participates in heat exchange in the third heat exchanger 615) will gradually approach the temperature of the environment in which the third heat exchanger 615 is located. When a saturation temperature corresponding to pressure in the third heat exchanger 615 is higher than the temperature of the air medium in the third heat exchanger 615 or the environment in which it is located, the refrigerant in the third heat exchanger 615 will liquefy to liquid refrigerant, thereby causing the pressure in the third heat exchanger 615 to drop, with the result that gaseous refrigerant in the seventh series-connected path 900 continuously migrates to the non-operational third heat exchanger 615, and is continuously converted to liquid refrigerant that accumulates therein. This will result in a reduction in the amount of refrigerant moving in the seventh series-connected path 900, thereby affecting the normal operation of the refrigeration system 600.

Thus, when the seventh operating system is running, the pressure of the operating system low-pressure side (i.e. at point Q) is detected by means of the pressure detection device 656, and the temperature in the third heat exchanger 615 is detected by means of the second temperature detection device 654. Saturation temperatures corresponding to different pressures of refrigerant are stored in the control device 644; thus, based on the pressure value detected by the pressure detection device 656, the saturation temperature of the refrigerant at this pressure can be obtained. When the saturation temperature of refrigerant corresponding to the pressure of the operating system low-pressure side (i.e. at point Q) is lower than the temperature in the third heat exchanger 615 as detected by the second temperature detection device 654, the pressure of the operating system low-pressure side (i.e. at point Q) is also lower than the pressure in the third heat exchanger 615, and the control device 644 will open the second disconnection device 614, thus connecting the second discharge path 624, and thereby enabling the refrigerant that has accumulated inside the third heat exchanger 615 to migrate towards the operating system low-pressure side of the refrigeration system 600 due to the pressure difference. When the saturation temperature of refrigerant corresponding to the pressure of the operating system low-pressure side (i.e. at point Q) is not lower than the temperature in the third heat exchanger 615 as detected by the second temperature detection device 654, the control device 644 will reduce the degree of opening of the first throttle valve 609, such that the pressure of the operating system low-pressure side (i.e. at point Q) drops, so that the pressure of the operating system low-pressure side (i.e. at point Q) is also lower than the pressure in the third heat exchanger 615, at which time the saturation temperature of refrigerant corresponding to the pressure of the operating system low-pressure side (i.e. at point Q) is lower than the temperature in the third heat exchanger 615. The control device 644 then opens the second disconnection device 614, thus connecting the second discharge path 624, and thereby enabling the refrigerant that has accumulated inside the third heat exchanger 615 to migrate towards the operating system low-pressure side. After discharge has taken place through the second discharge path 624 for a period of time, the pressure of the operating system low-pressure side (i.e. at point Q) is the same as the pressure in the third heat exchanger 615, i.e. the saturation temperature corresponding to the pressure of the operating system low-pressure side (i.e. at point Q) is the same as the temperature in the third heat exchanger 615; at this time, the control device 644 disconnects the second discharge path 624 by closing the second disconnection device 614. In some embodiments, the control device 644 closes the second disconnection device 614 when the second discharge path 624 has been connected (i.e. refrigerant inside the third heat exchanger 615 has been discharged) for 2-5 minutes.

The arrangement described above enables refrigerant that has accumulated inside the third heat exchanger 615 to migrate into the seventh series-connected path 900 of the seventh operating system, thereby avoiding shortage of refrigerant in the operating system when the refrigeration system 600 is running in the seventh operating system.

Figure 10:
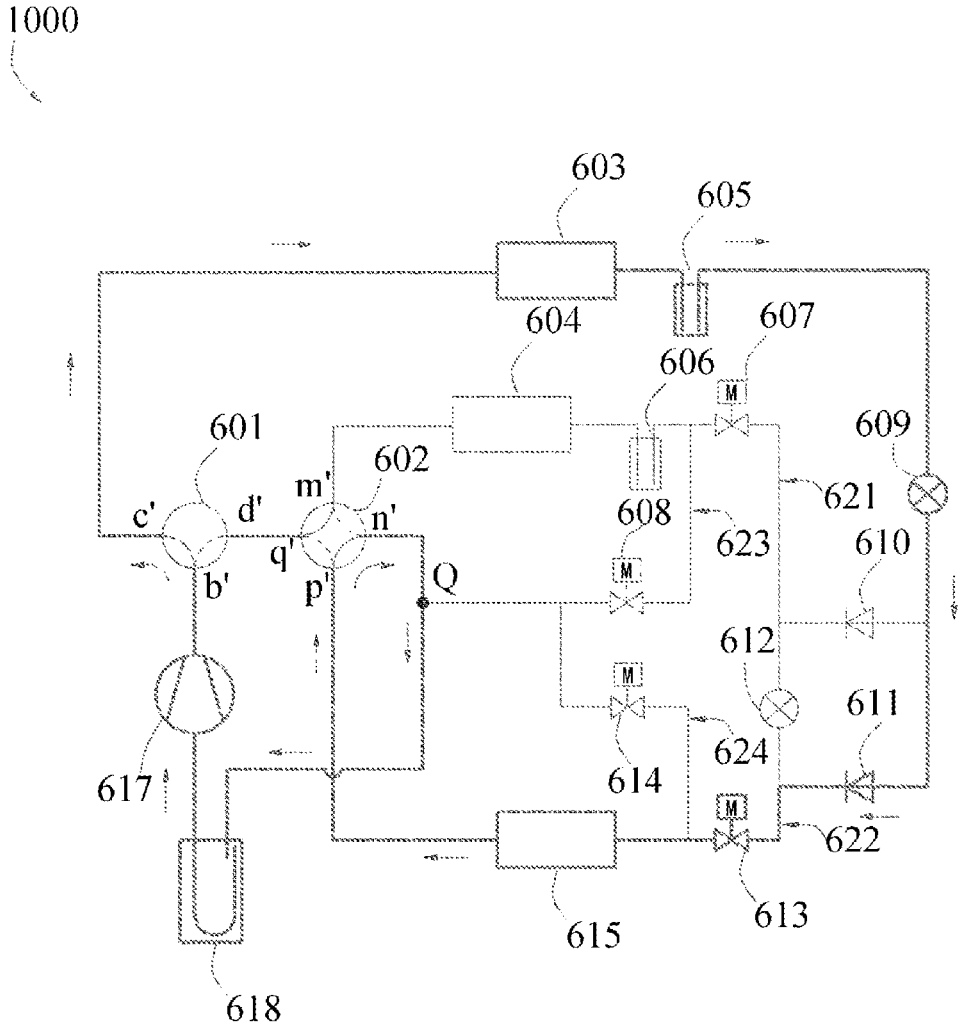
FIG. 10 shows a circulation path of an eighth series-connected path of the refrigeration system shown in FIG. 6.

FIG. 10 shows a circulation path when the refrigeration system 600 shown in FIG. 6A is set to the eighth operating system. When the refrigeration system 600 is set to the eighth operating system, hot water can be supplied to the user end via the first heat exchanger 603. Specifically, when the refrigeration system 600 is set to the eighth operating system, an eighth series-connected path 1000 can be formed. The seventh disconnection device 613 and first throttle valve 609 are in an open state; the second throttle valve 612, sixth disconnection device 607, first disconnection device 608 and second disconnection device 614 are in a closed state. In the first switching assembly 601, the first three-way controllable path b'c' is connected and the second three-way controllable path b'd' is disconnected; and in the second switching assembly 602, the second set of control paths are connected and the first set of control paths are disconnected. The arrows in FIG. 10 show the flow direction of refrigerant in the eighth series-connected path 1000.

As shown in FIG. 10, the eighth series-connected path 1000 sequentially connects the compressor 617, first three-way controllable path b'c', first heat exchanger 603, first liquid reservoir 605, first throttle valve 609, second one-way valve 611, seventh disconnection device 613, third heat exchanger 615, fourth control path n'p' and gas/liquid separator 618. The first heat exchanger 603 acts as a condenser, the third heat exchanger 615 acts as an evaporator, and the second heat exchanger 604 is in a non-operational state. The statement "the second heat exchanger 604 is in a non-operational state" means: refrigerant can flow through the second heat exchanger 604, but refrigerant in the second heat exchanger 604 is not used for the heating or cooling of water supplied to the user end.

When the eighth operating system is running, since the second heat exchanger 604 is not operational, the temperature of a medium in the second heat exchanger 604 (i.e. water that participates in heat exchange in the second heat exchanger 604) will gradually approach the temperature of the environment in which the second heat exchanger 604 is located. When a saturation temperature corresponding to pressure in the second heat exchanger 604 is higher than the temperature of the water medium in the second heat exchanger 604 or the environment in which it is located, the refrigerant in the second heat exchanger 604 will liquefy to liquid refrigerant, thereby causing the pressure in the second heat exchanger 604 to drop, with the result that gaseous refrigerant in the eighth series-connected path 1000 continuously migrates to the non-operational second heat exchanger 604, and is continuously converted to liquid refrigerant that accumulates therein. This will result in a reduction in the amount of refrigerant moving in the eighth series-connected path 1000, thereby affecting the normal operation of the refrigeration system 600.

Thus, when the eighth operating system is running, the pressure of the operating system low-pressure side (i.e. at point Q) is detected by means of the pressure detection device 656, and the temperature in the second heat exchanger 604 is detected by means of the first temperature detection device 652. Saturation temperatures corresponding to different pressures of refrigerant are stored in the control device 644; thus, based on the pressure value detected by the pressure detection device 656, the saturation temperature of the refrigerant at this pressure can be obtained. When the saturation temperature of refrigerant corresponding to the pressure of the operating system low-pressure side (i.e. at point Q) is lower than the temperature in the second heat exchanger 604 as detected by the first temperature detection device 652, the pressure of the operating system low-pressure side (i.e. at point Q) is also lower than the pressure in the second heat exchanger 604, and the control device 644 will open the first disconnection device 608, thus connecting the first discharge path 623, and thereby enabling the refrigerant that has accumulated inside the second heat exchanger 604 to migrate towards the operating system low-pressure side due to the pressure difference. When the saturation temperature of refrigerant corresponding to the pressure of the operating system low-pressure side (i.e. at point Q) is not lower than the temperature in the second heat exchanger 604 as detected by the first temperature detection device 652, the control device 644 will reduce the degree of opening of the first throttle valve 609, such that the pressure of the operating system low-pressure side drops, so that the pressure of the operating system low-pressure side (i.e. at point Q) is also lower than the pressure in the second heat exchanger 604, at which time the saturation temperature corresponding to the pressure of the operating system low-pressure side (i.e. at point Q) is lower than the temperature in the second heat exchanger 604. The control device 644 then opens the first disconnection device 608, thus connecting the first discharge path 623, and thereby enabling the refrigerant that has accumulated inside the second heat exchanger 604 to migrate towards the operating system low-pressure side. After discharge has taken place through the first discharge path 623 for a period of time, the pressure of the operating system low-pressure side (i.e. at point Q) is the same as the pressure in the second heat exchanger 604, i.e. the saturation temperature corresponding to the pressure of the operating system low-pressure side (i.e. at point Q) is the same as the temperature in the second heat exchanger 604; at this time, the control device 644 disconnects the first discharge path 623 by closing the first disconnection device 608. In some embodiments, the control device 644 closes the first disconnection device 608 when the first discharge path 623 has been connected (i.e. refrigerant inside the second heat exchanger 604 has been discharged) for 2-5 minutes.

The arrangement described above enables refrigerant that has accumulated inside the second heat exchanger 604 to migrate into the eighth series-connected path 1000 of the eighth operating system, thereby avoiding shortage of refrigerant in the operating system when the refrigeration system 600 is running in the eighth operating system.

It can be seen from FIGS. 9 and 10 that the seventh operating system and eighth operating system can be implemented by path switching in the second switching assembly 602 and connection or disconnection of the sixth disconnection device 607 and seventh disconnection device 613. Specifically, the seventh series-connected path 900 can be switched to the eighth series-connected path 1000 by switching the second switching assembly 602 from a configuration in which the first set of control paths are connected, to a configuration in which the second set of control paths are connected, closing the sixth disconnection device 607 and opening the seventh disconnection device 613.

It must be explained that although the first heat exchangers 102, 603 and second heat exchangers 112, 604 in the refrigeration system 100 and refrigeration system 600 of the present application are water-side heat exchangers, and the third heat exchangers 113, 615 are wind-side heat exchangers, those skilled in the art could configure them as different types of heat exchangers according to actual needs. In addition, the first switching assembly 601 is not limited to using a three-way valve, the path switching device 114 and second switching assembly 602 are not limited to using four-way valves, and the first disconnection device 110, second disconnection device 111, third disconnection device 104, fourth disconnection device 106, fifth disconnection device 109, sixth disconnection device 607 and seventh disconnection device 613 are not limited to using solenoid valves, but could be configured as various types of device capable of achieving connection and disconnection, e.g. a pump, etc., according to actual needs.

It must also be explained that although the gas/liquid separator and liquid reservoir are provided in the present application, it is also possible for the gas/liquid separator and/or the liquid reservoir not to be provided.

Furthermore, although the present application shows embodiments of two refrigeration systems having three heat exchangers, those skilled in the art will understand that in the case of a refrigeration system having four or more heat exchangers, when the temperature of the medium in a non-operational heat exchanger or the temperature of the environment in which it is located might be lower than the saturation temperature corresponding to the pressure in the heat exchanger, such that refrigerant will be likely to accumulate in the heat exchanger, it is also possible, in accordance with the spirit of the present application, to provide a discharge path for the refrigerant in the heat exchanger to migrate into the currently operating system circulation, so that there is enough refrigerant in the currently operating system.

It must also be explained that although the non-operational heat exchanger is connected to the operating system low-pressure side point C via the discharge path in the first embodiment of the present application, and the non-operational heat exchanger is connected to the operating system low-pressure side point Q via the discharge path in the second embodiment, in other embodiments the discharge path could also connect the non-operational heat exchanger to another position at the operating system low-pressure side, for example, connect the non-operational heat exchanger directly to the gas suction end of the compressor.

Although only some features of the present application have been illustrated and described herein, those skilled in the art could make various improvements and changes. Thus, it should be understood that the attached claims are intended to cover all such improvements and changes falling within the scope of the substantive spirit of the present application.

The invention claimed is:

1. A refrigeration system, wherein the refrigeration system comprises:

refrigeration system components comprising a compressor, a first heat exchanger, a second heat exchanger, a third heat exchanger, a first throttle valve and a second throttle valve;

connecting pipelines configured to connect the refrigeration system components and configured to combine the refrigeration system components in different ways to form a plurality of operating systems, wherein each operating system of the plurality of operating systems is different from one another;

a switch structure configured to connect the connecting pipelines to form an operating system of the plurality of operating systems and configured to select, from the first heat exchanger, the second heat exchanger and the third heat exchanger, two heat exchangers for connection into the operating system, and to isolate a non-selected heat exchanger from the operating system; and a discharge path configured to be selectively arranged between the non-selected heat exchanger and a low-pressure side of the operating system; and a control device configured to connect the non-selected heat exchanger to the low-pressure side of the operating system via the discharge path in response to:

a temperature of a medium that undergoes heat transfer with a refrigerant in the non-selected heat exchanger being lower than a saturation temperature of refrigerant in the non-selected heat exchanger; or a temperature of an environment in which the non-selected heat exchanger is located being lower than the saturation temperature of refrigerant in the non-selected heat exchanger.

2. The refrigeration system of claim 1, wherein:

when the discharge path is arranged between the non-selected heat exchanger and the low-pressure side of the operating system, the refrigeration system is configured such that:

(i) when a pressure of the low-pressure side of the operating system is lower than a pressure in the non-selected heat exchanger, the discharge path is connected so that refrigerant in the non-selected heat exchanger flows into the low-pressure side of the operating system; and (ii) when the pressure of the low-pressure side of the operating system is not lower than the pressure in the non-selected heat exchanger, the first throttle valve or the second throttle valve is first adjusted to lower the pressure of the low-pressure side of the operating system, so that refrigerant in the non-selected heat exchanger is able to flow into the low-pressure side of the operating system, the discharge path is then connected so that refrigerant in the non-selected heat exchanger flows into the low-pressure side of the operating system, and the discharge path is disconnected when discharge of refrigerant in the non-selected heat exchanger has taken place for a period of time.

3. The refrigeration system of claim 2, wherein:

the discharge path comprises a discharge switch device configured to control connection and disconnection of the discharge path.

4. The refrigeration system of claim 3, wherein:

the discharge switch device comprises a first disconnection device and a second disconnection device;

the first disconnection device is configured to connect the second heat exchanger to, or disconnect the second heat exchanger from, a respective low-pressure side of a first operating system of the plurality of operating systems formed by the compressor, the first heat exchanger, the third heat exchanger and either one or both of the first throttle valve and the second throttle valve; and the second disconnection device is configured to connect the third heat exchanger to, or disconnect the third heat exchanger from, a low-pressure side of a second operating system formed by the compressor, the first heat exchanger, the second heat exchanger and either one or both of the first throttle valve and the second throttle valve.

5. The refrigeration system of claim 4, wherein the refrigeration system further comprises:

a pressure detection device configured to detect the pressure of the low-pressure side of the operating system and to provide a pressure detection signal; and a temperature detection device configured to detect a temperature in the non-selected heat exchanger and to provide a temperature detection signal.

6. The refrigeration system of claim 5, wherein the control device is in communicative connection with the discharge switch device and is configured to control connection and disconnection of the discharge path according to the pressure detection signal provided by the pressure detection device and the temperature detection signal provided by the temperature detection device.

7. The refrigeration system of claim 2, wherein:

the plurality of operating systems comprises a first operating system and a second operating system;

the first operating system is formed by connection of a first series-connected path, the first series-connected path serially connecting in sequence the compressor, the first heat exchanger, the second heat exchanger, the first throttle valve and the third heat exchanger, wherein the first heat exchanger and the second heat exchanger are configured to operate as condensers in the first operating system, and the third heat exchanger is configured to operate as an evaporator in the first operating system;

the second operating system is formed by connection of a second series-connected path, the second series-connected path serially connecting in sequence the compressor, the first heat exchanger, the third heat exchanger, the first throttle valve and the second heat exchanger, wherein the first heat exchanger and the third heat exchanger are configured to operate as condensers of the second operating system, and the second heat exchanger is configured to operate as an evaporator of the second operating system; and the switch structure comprises a path switching device, and the first operating system and the second operating system are configured to be selectively switched via the path switching device.

8. The refrigeration system of claim 7, wherein:

the switch structure further comprises a third disconnection device, a fourth disconnection device and a fifth disconnection device; the third disconnection device is connected between the first heat exchanger and the path switching device; the fourth disconnection device is connected between the second heat exchanger and the first throttle valve; and the fifth disconnection device is connected between the third heat exchanger and the first throttle valve;

the second throttle valve comprises a first end connected between the first heat exchanger and the third disconnection device, and comprises a second end connected between the fourth disconnection device and the first throttle valve; and the plurality of operating systems further comprises a third operating system and a fourth operating system;

the third operating system is formed by a third series-connected path, and when the third operating system is formed, the third series-connected path is configured such that: the third disconnection device and the fourth disconnection device are disconnected, the second heat exchanger in the first series-connected path is separated from the first series-connected path, and a sequential series connection of the compressor, the first heat exchanger, the second throttle valve, the first throttle valve and the third heat exchanger is maintained, wherein the first heat exchanger is configured to operate as a condenser of the third operating system, and the third heat exchanger is configured to operate as an evaporator of the third operating system; and the fourth operating system is formed by a fourth series-connected path, and when the fourth operating system is formed, the fourth series-connected path is configured such that: the third disconnection device and the fifth disconnection device are disconnected, the third heat exchanger in the second series-connected path is separated from the second series-connected path, and a sequential series connection of the compressor, the first heat exchanger, the second throttle valve and the second heat exchanger is maintained, wherein the first heat exchanger is configured to operate as a condenser of the fourth operating system, and the second heat exchanger is configured to operate as an evaporator of the fourth operating system.

9. The refrigeration system of claim 8, wherein:

the path switching device is a four-way valve comprising a first pair of controllable paths and a second pair of controllable paths;

the first pair of controllable paths comprises a first controllable path and a second controllable path, the first controllable path is connected between the third disconnection device and the second heat exchanger, and the second controllable path is connected between the third heat exchanger and the compressor;

the second pair of controllable paths comprises a third controllable path and a fourth controllable path, the third controllable path is connected between the third disconnection device and the third heat exchanger, and the fourth controllable path is connected between the second heat exchanger and the compressor;

wherein the first pair of controllable paths is configured to connect the first series-connected path and the third series-connected path; and the second pair of controllable paths is configured to connect the second series-connected path and the fourth series-connected path.

10. The refrigeration system of claim 2, wherein:

the plurality of operating systems comprises a first combined operating system and a second combined operating system;

the switch structure comprises a first switching assembly configured to switch the first combined operating system and second combined operating system;

the first combined operating system comprises a fifth operating system and a sixth operating system;

the fifth operating system is formed by a fifth series-connected path comprising the compressor, the third heat exchanger, the second throttle valve and the second heat exchanger connected in sequence, wherein the third heat exchanger is configured to operate as a condenser of the fifth operating system, and the second heat exchanger is configured to operate as an evaporator of the fifth operating system;

the sixth operating system is formed by a sixth series-connected path comprising the compressor, the second heat exchanger, the second throttle valve and the third heat exchanger connected in sequence, wherein the second heat exchanger is configured to operate as a condenser of the sixth operating system, and the third heat exchanger is configured to operate as an evaporator of the sixth operating system; and the switch structure comprises a second switching assembly, and the fifth operating system and the sixth operating system are configured to be switched via the second switching assembly.

11. The refrigeration system of claim 10, wherein:

the second combined operating system comprises a seventh operating system and an eighth operating system;

the seventh operating system is formed by a seventh series-connected path comprising the compressor, the first heat exchanger, the first throttle valve and the second heat exchanger connected in sequence, wherein the first heat exchanger is configured to operate as a condenser of the seventh operating system, and the second heat exchanger is configured to operate as an evaporator of the seventh operating system;

the eighth operating system is formed by an eighth series-connected path comprising the compressor, the first heat exchanger, the first throttle valve and the third heat exchanger connected in sequence, wherein the first heat exchanger is configured to operate as a condenser of the eighth operating system, and the third heat exchanger is configured to operate as an evaporator of the eighth operating system; and the switch structure further comprises a third switching assembly, and the seventh operating system and the eighth operating system are configured to be via a combination of the second switching assembly and the third switching assembly.

12. The refrigeration system of claim 11, wherein:

the first switching assembly is a three-way valve comprising a first three-way controllable path and a second three-way controllable path, the first three-way controllable path is connected between the first heat exchanger and the compressor, and the second three-way controllable path is connected between the second switching assembly and the compressor;

wherein the first three-way controllable path is configured to connect the seventh series-connected path and the eighth series-connected path, and the second three-way controllable path is configured to connect the fifth series-connected path and the sixth series-connected path;

the second switching assembly is a four-way valve comprising a first set of control paths and a second set of control paths;

the first set of control paths comprises a first control path and a second control path, the first control path is connected between the first switching assembly and the second heat exchanger, and the second control path is connected between the third heat exchanger and the compressor;

the second set of control paths comprises a third control path and a fourth control path, the third control path is connected between the first switching assembly and the third heat exchanger, and the fourth control path is connected between the second heat exchanger and the compressor;

wherein the first set of control paths is configured to connect the sixth series-connected path and the eighth series-connected path, and the second set of control paths is configured to connect the fifth series-connected path and the seventh series-connected path;

the third switching assembly comprises a sixth disconnection device and a seventh disconnection device;

the sixth disconnection device is connected between the second heat exchanger and the first throttle valve, and the seventh disconnection device is connected between the third heat exchanger and the first throttle valve; and wherein the sixth disconnection device is configured to connect the seventh series-connected path; and the seventh disconnection device is configured to connect the eighth series-connected path.

13. The refrigeration system of claim 1, wherein:

the first heat exchanger and the second heat exchanger are both water-side heat exchangers, and the third heat exchanger is a wind-side heat exchanger.

14. The refrigeration system of claim 1, comprising:

a gas/liquid separator provided at a gas suction side of the compressor.

* * * * *